US010672325B2

(12) United States Patent
Woo et al.

(10) Patent No.: US 10,672,325 B2
(45) Date of Patent: Jun. 2, 2020

(54) LIGHT EMITTING DISPLAY DEVICE

(71) Applicant: SAMSUNG DISPLAY CO., LTD., Yongin-si, Gyeonggi-do (KR)

(72) Inventors: Minkyu Woo, Gwangmyeong-si (KR); Jaesic Lee, Seoul (KR); Takyoung Lee, Anyang-si (KR); Jintae Jeong, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 10 days.

(21) Appl. No.: 15/826,436

(22) Filed: Nov. 29, 2017

(65) Prior Publication Data

US 2018/0151111 A1 May 31, 2018

(30) Foreign Application Priority Data

Nov. 30, 2016 (KR) ..... 10-2016-0161658

(51) Int. Cl.

*G09G 3/32* (2016.01)
*G09G 3/3208* (2016.01)
*G09G 3/3233* (2016.01)

(52) U.S. Cl.

CPC ..... *G09G 3/32* (2013.01); *G09G 3/3208* (2013.01); *G09G 3/3233* (2013.01); *G09G 2300/0426* (2013.01); *G09G 2300/0842* (2013.01); *G09G 2310/08* (2013.01); *G09G 2320/0666* (2013.01); *G09G 2330/00* (2013.01); *G09G 2330/021* (2013.01)

(58) Field of Classification Search

CPC ..... G09G 3/32; G09G 3/3208; G09G 3/3233; G09G 2300/0426; G09G 2300/0842; G09G 2310/08; G09G 2320/0666; G09G 2330/00; G09G 2330/021

See application file for complete search history.

(56) References Cited

U.S. PATENT DOCUMENTS 6,309,271 B1 * 10/2001 Kim ..... H01J 9/085 445/24
9,495,906 B2 11/2016 Ishii et al.
2004/0149886 A1 * 8/2004 Matsueda ..... G09G 3/3233 250/208.1

(Continued)

FOREIGN PATENT DOCUMENTS

KR 10-0707633 4/2007
KR 10-0729060 6/2007
KR 10-2014-0075591 6/2014

*Primary Examiner* — Amare Mengistu
*Assistant Examiner* — Crystal Mathews
(74) *Attorney, Agent, or Firm* — Lewis Roca Rothgerber Christie LLP

(57) ABSTRACT

A light emitting display device includes: a display panel including a plurality of pixel groups arranged along a first direction; first, second, and third pixels in each of the pixel groups, arranged in a second direction which crosses the first direction, and respectively emitting light having different colors; a light emitting element in each of the first, second and third pixels; a first power supply line connected to the light emitting element of each first pixel of each pixel group; a second power supply line connected to the light emitting element of each second pixel of each pixel group; and a third power supply line connected to the light emitting element of each third pixel of each pixel group.

17 Claims, 11 Drawing Sheets

(56) References Cited

U.S. PATENT DOCUMENTS

| | | | | |
|---|---|---|---|---|
| 2005/0051776 | A1* | 3/2005 | Miyagi | G09G 3/3233 257/72 |
| 2009/0146986 | A1 | 6/2009 | Kim | |
| 2009/0244055 | A1* | 10/2009 | Asano | G09G 3/3233 345/214 |
| 2011/0267327 | A1* | 11/2011 | Hwang | G09G 3/3208 345/211 |
| 2014/0009509 | A1* | 1/2014 | Eom | G09G 3/3291 345/690 |
| 2014/0035798 | A1* | 2/2014 | Kawada | G09G 3/3208 345/77 |
| 2014/0292822 | A1* | 10/2014 | Lee | G09G 3/3233 345/690 |
| 2017/0069262 | A1* | 3/2017 | Wu | G09G 3/3225 |
| 2017/0092197 | A1* | 3/2017 | Fujimura | G09G 3/3233 |
| 2017/0352312 | A1* | 12/2017 | Ebisuno | G09G 3/2074 |

* cited by examiner

LIGHT EMITTING DISPLAY DEVICE

CROSS-REFERENCE TO RELATED APPLICATION

This application claims priority to and the benefit of Korean Patent Application No. 10-2016-0161658, filed on Nov. 30, 2016, in the Korean Intellectual Property Office (KIPO), the disclosure of which is incorporated by reference herein in its entirety.

1. FIELD

Embodiments of the present invention relate to a display device, and more particularly, to a light emitting display device which may maintain a proper white balance and have high space utilization.

2. BACKGROUND

Flat panel display ("FPD") devices are advantageous in that they may reduce weight and volume, which are disadvantages of cathode ray tubes ("CRT"). Examples of the FPD devices may include liquid crystal display ("LCD") devices, field emission display ("FED") devices, plasma display panel ("PDP") devices, OLED display devices and the like.

Among the FPD devices, the OLED display device displays an image using an OLED which may generate light by recombination of electrons and holes.

It is to be understood that this background section is intended to provide useful background for understanding the technology and as such, the background section may include ideas, concepts or recognitions that were not part of what was known or appreciated by those skilled in the pertinent art prior to a corresponding effective filing date of subject matter disclosed herein.

SUMMARY

Embodiments of the present invention may be directed to a light emitting display device capable of maintaining a proper white balance and having high space utilization.

According to an exemplary embodiment, a light emitting display device includes: a display panel including a plurality of pixel groups arranged along a first direction; first, second, and third pixels included in each of the pixel groups, arranged in a second direction which crosses the first direction, and respectively configured to emit light having different colors; a light emitting element included in each of the first, second and third pixels; a first power supply line connected to the light emitting element of each of the first pixels of each of the pixel groups; a second power supply line connected to the light emitting element of each of the second pixels of each of the pixel groups; a third power supply line connected to the light emitting element of each of the third pixels of each of the pixel groups; at least one first main supply line and at least one first auxiliary supply line included in the first power supply line and connected to each other; at least one second main supply line and at least one second auxiliary supply line included in the second power supply line and connected to each other; and at least one third main supply line and at least one third auxiliary supply line included in the third power supply line and connected to each other. Said at least one first auxiliary supply line, said at least one second auxiliary supply line, and said at least one third auxiliary supply line are located between a p-th pixel group and a (p+1)-th pixel group, and p is one of an odd number and an even number.

Said at least one first auxiliary supply line, said at least one second auxiliary supply line, and said at least one third auxiliary supply line may be located between a (2q−1)-th pixel group and a 2q-th pixel group which are adjacent to each other. Said at least one first auxiliary supply line, said at least one second auxiliary supply line, and said at least one third auxiliary supply line may not be located between the 2q-th pixel group and a (2q+1)-th pixel group which are adjacent to each other. q may be a natural number.

Said at least one first auxiliary supply line, said at least one second auxiliary supply line, and said at least one third auxiliary supply line may be located between a 2q-th pixel group and a (2q+1)-th pixel group which are adjacent to each other. Said at least one first auxiliary supply line, said at least one second auxiliary supply line, and said at least one third auxiliary supply line may be not located between a (2q−1)-th pixel group and the 2q-th pixel group which are adjacent to each other. q may be a natural number.

Each of said at least one first main supply line, said at least one second main supply line, and said at least one third main supply line may extend in the first direction. Said at least one first main supply line, said at least one second main supply line, and said at least one third main supply line may be arranged along the second direction.

Each of said at least one first auxiliary supply line, said at least one second auxiliary supply line, and said at least one third auxiliary supply line may extend in the second direction. Said at least one first auxiliary supply line, said at least one second auxiliary supply line, and said at least one third auxiliary supply line may be arranged along the first direction.

The light emitting display device may further include: a first power supply portion configured to apply a first driving power to at least one of said at least one first main supply line and said at least one first auxiliary supply line; a second power supply portion configured to apply a second driving power to at least one of said at least one second main supply line and said at least one second auxiliary supply line; and a third power supply portion configured to apply a third driving power to at least one of said at least one third main supply line and said at least one third auxiliary supply line.

The first power supply portion may be connected to one side end portion of said at least one first main supply line, the second power supply portion may be connected to one side end portion of said at least one second main supply line, and the third power supply portion may be connected to one side end portion of said at least one third main supply line.

The first power supply portion may be further connected to another side end portion of said at least one first main supply line, the second power supply portion may be further connected to another side end portion of said at least one second main supply line, and the third power supply portion may be further connected to another side end portion of said at least one third main supply line.

A largest current may flow through the third power supply line of the first power supply line, the second power supply line, and the third power supply line, and the third power supply portion may be further connected to another side end portion of said at least one third main supply line.

The first power supply portion may be further connected to one side end portion and another side end portion of said at least one first auxiliary supply line.

The first power supply portion may be further connected to another side of said at least one first main supply line, the second power supply portion may be further connected to another side of said at least one second main supply line, and the third power supply portion may be further connected to another side of said at least one third main supply line.

The first power supply portion may be further connected to one side end portion and another side end portion of the first auxiliary supply line, the second power supply portion may be further connected to one side end portion and another side end portion of the second auxiliary supply line, and the third power supply portion may be further connected to one side end portion and another side end portion of the third auxiliary supply line.

A largest current may flow through the third power supply line of the first power supply line, the second power supply line, and the third power supply line, and the third power supply portion may be further connected to another side end portion of said at least one third main supply line, one side end portion of said at least one third auxiliary supply line, and another side end portion of said at least one third auxiliary supply line.

The second power supply portion may be further connected to another side end portion of said at least one second auxiliary supply line, and the third power supply portion may be further connected to another side end portion of said at least one third main supply line.

At least two of the first, second, and third power supply lines may have different widths.

A largest current may flow through the third power supply line of the first power supply line, the second power supply line, and the third power supply line, and the third power supply line of the first power supply line, the second power supply line, and the third power supply line may have a largest width.

According to an exemplary embodiment, a light emitting display device includes: a display panel including a plurality of pixel groups arranged along a first direction; first, second, and third pixels included in each of the pixel groups, arranged in a second direction which crosses the first direction, and respectively configured to emit light having different colors; a light emitting element included in each of the first, second, and third pixels; a first power supply line connected to the light emitting element of each of the first pixels of each of the pixel groups; a second power supply line connected to the light emitting element of each of the second pixels of each of the pixel groups; a third power supply line connected to the light emitting element of each of the third pixels of each of the pixel groups; at least one first main supply line and at least one first auxiliary supply line included in the first power supply line and connected to each other; at least one second main supply line and at least one second auxiliary supply line included in the second power supply line and connected to each other; and at least one third main supply line and at least one third auxiliary supply line included in the third power supply line and connected to each other. Said at least one first auxiliary supply line is located between a (3q−2)-th pixel group and a (3q−1)-th pixel group, said at least one second auxiliary supply line is located between the (3q−1)-th pixel group and a 3q-th pixel group, said at least one third auxiliary supply line is located between the 3q-th pixel group and a (3q+1)-th pixel group, where q is a natural number.

Each of said at least one first main supply line, said at least one second main supply line, and said at least one third main supply line may extend in the first direction, and said at least one first main supply line, said at least one second main supply line, and said at least one third main supply line may be arranged along the second direction.

Each of said at least one first auxiliary supply line, said at least one second auxiliary supply line, and said at least one third auxiliary supply line may extend in the second direction, and said at least one first auxiliary supply line, said at least one second auxiliary supply line, and said at least one third auxiliary supply line may be arranged along the first direction.

The light emitting display device may further include: a first power supply portion configured to apply a first driving power to at least one of said at least one first main supply line and said at least one first auxiliary supply line; a second power supply portion configured to apply a second driving power to at least one of said at least one second main supply line and said at least one second auxiliary supply line; and a third power supply portion configured to apply a third driving power to at least one of said at least one third main supply line and said at least one third auxiliary supply line.

The first power supply portion may be connected to one side end portion of said at least one first main supply line, the second power supply portion may be connected to one side end portion of said at least one second main supply line, and the third power supply portion may be connected to one side end portion of said at least one third main supply line.

A largest current may flow through the first power supply line of the first power supply line, the second power supply line, and the third power supply line, and the first power supply portion may be further connected to another side end portion of said at least one first main supply line.

At least two of the first, second, and third power supply lines may have different widths.

A largest current may flow through the third power supply line of the first power supply line, the second power supply line, and the third power supply line, and the third power supply line of the first power supply line, the second power supply line, and the third power supply line may have a largest width.

The foregoing is illustrative only and is not intended to be in any way limiting. In addition to the illustrative aspects, exemplary embodiments and features described above, further aspects, exemplary embodiments and features will become apparent by reference to the drawings and the following detailed description.

BRIEF DESCRIPTION OF THE DRAWINGS

A more complete appreciation of the present invention will become apparent by describing, in detail, exemplary embodiments thereof with reference to the accompanying drawings, wherein.

DETAILED DESCRIPTION

Figure 1:
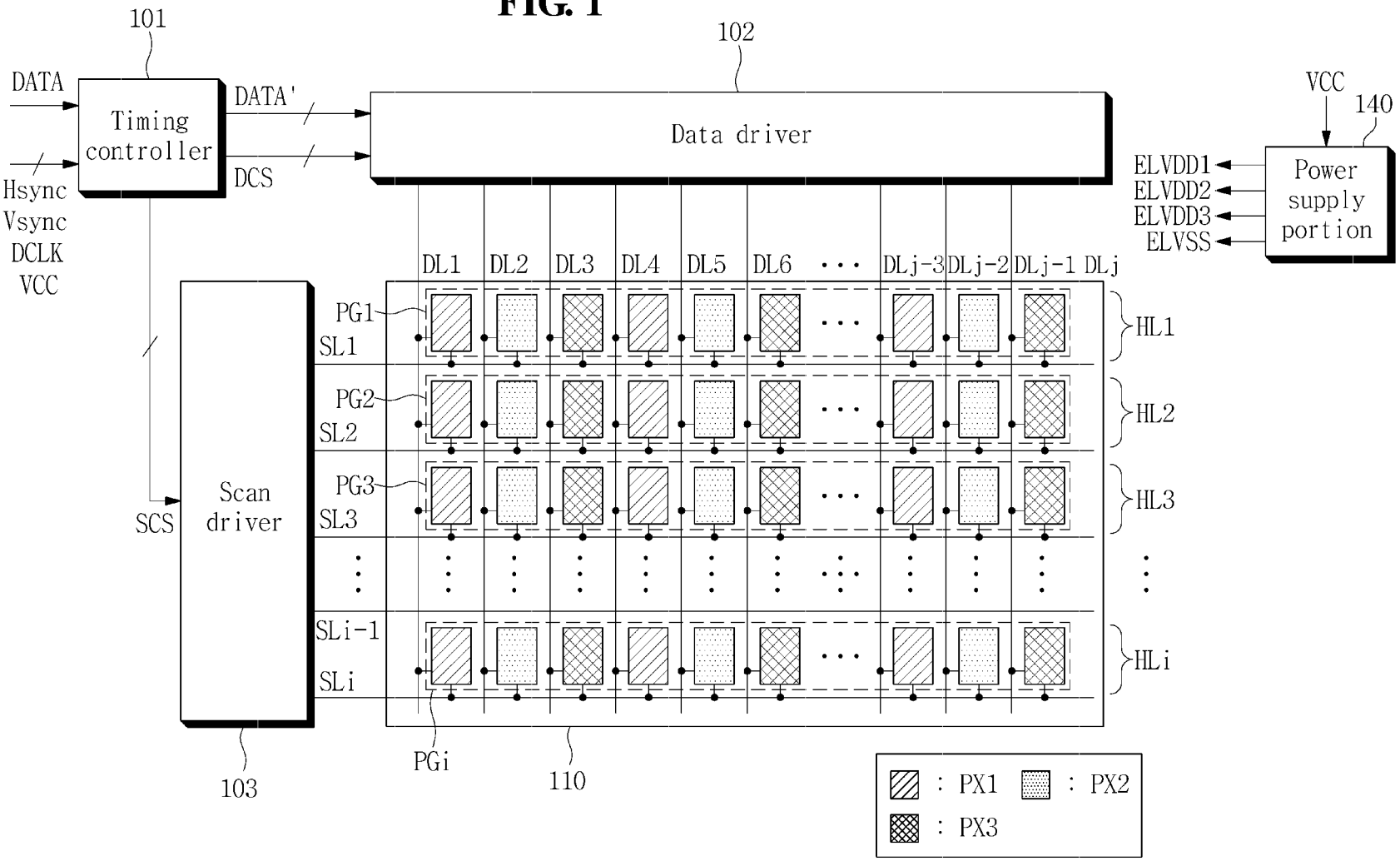
FIG. 1 is a block diagram illustrating a light emitting display device according to an exemplary embodiment.

Exemplary embodiments will now be described more fully hereinafter with reference to the accompanying drawings. Although the invention may be modified in various manners and have several exemplary embodiments, exemplary embodiments are illustrated in the accompanying drawings and will be mainly described in the specification. However, the scope of the invention is not limited to the exemplary embodiments and should be construed as including all the changes, equivalents and substitutions included in the spirit and scope of the invention.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below," "beneath," "lower," "above," "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device located "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "including," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Some of the parts which are not associated with the description may not be provided in order to specifically describe embodiments of the present invention and like reference numerals refer to like elements throughout the specification.

Hereinafter, a light emitting display device according to exemplary embodiments of the present invention will be described in detail with reference to FIGS. 1 to 11.

Figure 2:
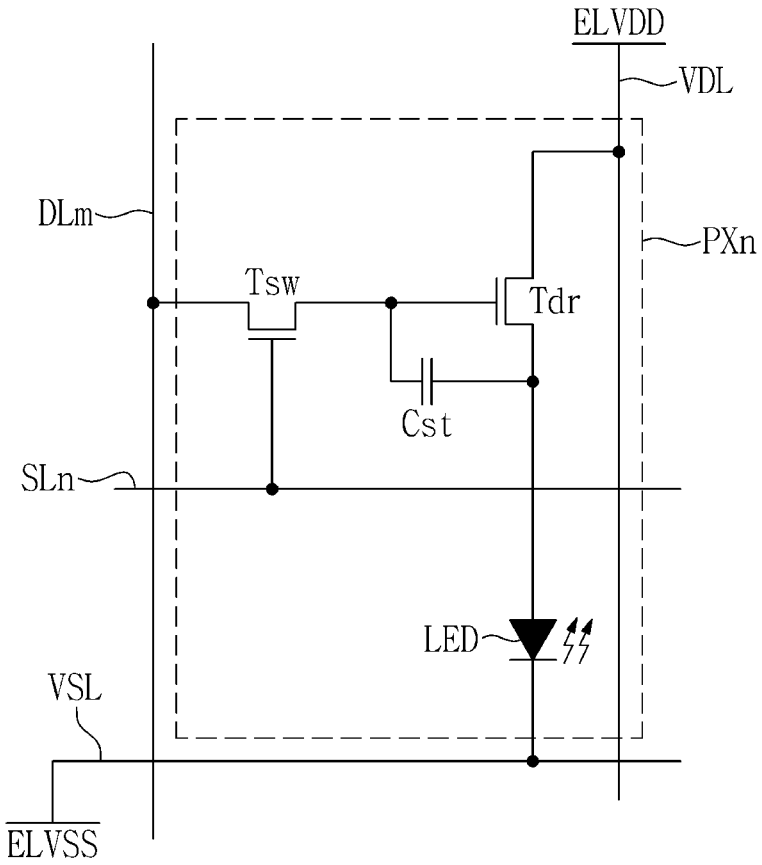
FIG. 2 is a detailed configuration diagram illustrating one of the pixels illustrated in FIG. 1.

FIG. 1 is a block diagram illustrating a light emitting display device according to an exemplary embodiment and FIG. 2 is a detailed configuration diagram illustrating one of pixels illustrated in FIG. 1.

As illustrated in FIG. 1, the light emitting display device includes a display panel 110, a timing controller 101, a scan driver 103, a data driver 102, and a power supply portion 140.

The display panel 110 includes i number of scan lines SL1 to SLi, j number of data lines DL1 to DLj, and i*j number of pixels PX1, PX2 and PX3, where each of i and j is a natural number greater than 1.

First to i-th scan signals are applied to the first to i-th scan lines SL1 to SLi and first to j-th data voltages are applied to the first to j-th data lines DL1 to DLj.

The pixels PX1, PX2 and PX3 are disposed at the display panel 110 in the form of a matrix. The pixels PX1, PX2 and PX3 may respectively emit light having different colors. For example, a first pixel PX1 may be a red pixel which emits a red light, a second pixel PX2 may be a green pixel which emits a green light and a third pixel PX3 may be a blue pixel which emits a blue light. The display panel 110 may further include at least one fourth pixel, which may be a white pixel emitting a white light.

The first pixel PX1 is connected to a (3k+1)-th data line, the second pixel PX2 is connected to the (3k+2)-th data line and the third pixel PX3 is connected to a (3k+3)-th data line, where k is 0 or a natural number. For example, the first pixels PX1 are connected to the first data line DL1, the second pixels PX2 are connected to the second data line DL2 and the third pixels PX3 are connected to the third data line DL2.

The first pixel PX1, the second pixel PX2 and the third pixel PX3 which are adjacent to each other in a horizontal direction may be a unit pixel for displaying one unit image. In the case where the display panel 110 further includes the fourth pixel described above, the first pixel PX1, the second pixel PX2, the third pixel PX3 and the fourth pixel which are adjacent to each other in the horizontal direction correspond to the aforementioned unit pixel.

In an exemplary embodiment, j number of pixels arranged along an n-th horizontal line (hereinafter, n-th horizontal line pixels) are individually connected to the first to j-th data lines DL1 to DLj, respectively, where n is one selected from 1 to i. In addition, the n-th horizontal line pixels are connected in common to the n-th scan line.

The n-th horizontal line pixels receive an n-th scan signal in common. That is, all of j number of pixels located in a same horizontal line receive a substantially same scan signal, but pixels located in different horizontal lines receive different scan signals, respectively. For example, the first pixels PX1, the second pixels PX2 and the third pixels PX3 in a first horizontal line HL1 all receive a first scan signal, while the first pixels PX1, the second pixels PX2 and the third pixels PX3 in a second horizontal line HL2 all receive a second scan signal that is output later in time than the first scan signal.

In such an exemplary embodiment, pixels in one horizontal line are to be defined as a pixel group. As illustrated in FIG. 1, i number of pixel groups at the display panel 110 are arranged along a first direction (hereinafter, a Y-axis direction). In other words, first to i-th pixel groups PG1 to PGi are arranged along the Y-axis direction. In an exemplary embodiment, j number of pixels included in one pixel group are arranged along a second direction (hereinafter, an X-axis direction). For example, the pixels PX1, PX2 and PX3 included in the first pixel group PG1 are arranged along the X-axis direction.

Each of the pixels PX1, PX2 and PX3 receives a first high electric potential driving voltage ELVDD1, a second high electric potential driving voltage ELVDD2, a third high electric potential driving voltage ELVDD3 and a low electric potential driving voltage ELVSS from the power supply portion 140. For example, the first pixel PX1 receives the first high electric potential driving voltage ELVDD1 and the low electric potential driving voltage ELVSS, the second pixel PX2 receives the second high electric potential driving voltage ELVDD2 and the low electric potential driving voltage ELVSS, and the third pixel PX3 receives the third high electric potential driving voltage ELVDD3 and the low electric potential driving voltage ELVSS.

Herein, one of the pixels illustrated in FIG. 1 will be described in detail with reference to FIG. 2.

As illustrated in FIG. 2, an n-th pixel PXn may include a driving switching element Tdr, a data switching element Tsw, a storage capacitor Cst and a light emitting element (e.g., a light emitting diode ("LED"), hereinafter denoted as LED). As used herein, the n-th pixel PXn may be one of the first pixel PX1, the second pixel PX2 and the third pixel PX3.

The data switching element Tsw includes a gate electrode connected to an n-th scan line SLn and is connected between an m-th data line DLm and a gate electrode of the driving switching element Tdr. A drain electrode of the data switching element Tsw is connected to the m-th data line DLm and a source electrode of the data switching element Tsw is connected to the gate electrode of the driving switching element Tdr, where m is a natural number.

The driving switching element Tdr includes the gate electrode connected to the source electrode of the data switching element Tsw and is connected between a power supply line VDL and an anode electrode of the LED. A drain electrode of the driving switching element Tdr is connected to the power supply line VDL and a source electrode of the driving switching element Tdr is connected to the anode electrode of the LED. In such an exemplary embodiment, the power supply line VDL may be one of a first power supply line, a second power supply line, and a third power supply line to be described below.

The driving switching element Tdr adjusts an amount (magnitude) of a driving current flowing from the power supply line VDL to a base power supply line VSL according to a magnitude of a signal applied to the gate electrode of the driving switching element Tdr.

The storage capacitor Cst is connected between the gate electrode of the driving switching element Tdr and the anode electrode of the LED. The storage capacitor Cst stores a signal applied to the gate electrode of the driving switching element Tdr for a period of one frame.

The LED emits light in accordance with the driving current applied through the driving switching element Tdr. The LED emits a light of different brightnesses depending on the level of the driving current. The anode electrode of the LED is connected to the drain electrode (or the source electrode) of the driving switching element Tdr and a cathode electrode of the LED is connected to the base power supply line VSL. The LED may be an OLED.

An LED of the first pixel PX1 may be a red LED which emits a red light, an LED of the second pixel PX2 may be a green LED which emits a green light, and an LED of the third pixel PX3 may be a blue LED which emits a blue light, but the present invention is not limited thereto.

As illustrated in FIG. 1, the timing controller 101 receives a vertical synchronization signal Vsync, a horizontal synchronization signal Hsync, an image data signal DATA and a reference clock signal DCLK, which are output from a graphic controller provided in a system.

An interface circuit is provided between the timing controller 101 and the system and the aforementioned signals output from the system are input to the timing controller 101 through the interface circuit. The interface circuit may be embedded in the timing controller 101.

The interface circuit may include a low voltage differential signaling (LVDS) receiver. The interface circuit lowers voltage levels of the vertical synchronization signal Vsync, the horizontal synchronization signal Hsync, the image data signal DATA and the reference clock signal DCLK output from the system, while raising frequencies thereof.

In an exemplary embodiment, electromagnetic interference (EMI) may occur due to high frequency components of the signal input from the interface circuit to the timing controller 101. In order to substantially prevent the EMI, an EMI filter may be further provided between the interface circuit and the timing controller 101.

The timing controller 101 generates a scan control signal SCS for controlling the scan driver 103 and a data control signal DCS for controlling the data driver 102, using the vertical synchronization signal Vsync, the horizontal synchronization signal Hsync and the reference clock signal DCLK.

The scan control signal SCS may include a gate start pulse, a gate shift clock, a gate output enable signal, and the like.

The data control signal DCS may include a source start pulse, a source shift clock, a source output enable signal, and the like.

In addition, the timing controller 101 rearranges the image data signals DATA input through the system and applies the rearranged image data signals DATA' to the data driver 102.

In an exemplary embodiment, the timing controller 101 is driven by a driving power VCC output from a power unit provided in the system. For example, the driving power VCC is used as a power voltage of a phase lock loop ("PLL") circuit embedded in the timing controller 101.

The PLL circuit compares the reference clock signal DCLK input to the timing controller 101 with a reference frequency generated from an oscillator. Then, in the case in which it is identified from the comparison that there is a difference between them, the PPL circuit adjusts the frequency of the reference clock signal DCLK by the difference to generate a sampling clock signal. This sampling clock signal is a signal for sampling the image data signals DATA'.

The power supply portion 140 increases or decreases the driving power VCC input through the system to generate various voltages required for the display panel 110. The power supply portion 140 may be a DC-DC converter.

The power supply portion 140 may include, for example, an output switching element for switching an output voltage of an output terminal of the power supply portion 140 and a pulse width modulator PWM for adjusting a duty ratio or a frequency of a control signal applied to a control terminal of the output switching element so as to increase or decrease the output voltage. Herein, the power supply portion 140 may include a pulse frequency modulator PFM, instead of the pulse width modulator PWM.

The pulse width modulator PWM may increase the duty ratio of the aforementioned control signal to raise the output voltage of the power supply portion 140 or decrease the duty ratio of the control signal to lower the output voltage of the power supply portion 140. The pulse frequency modulator PFM may increase the frequency of the aforementioned control signal to raise the output voltage of the power supply portion 140 or decrease the frequency of the control signal to lower the output voltage of the power supply portion 140.

The output voltage of the power supply portion 140 may include the first high electric potential driving voltage ELVDD1, the second high electric potential driving voltage ELVDD2, the third high electric potential driving voltage ELVDD3, and the low electric potential driving voltage ELVSS.

Each of the first high electric potential driving voltage ELVDD1, the second high electric potential driving voltage ELVDD2, the third high electric potential driving voltage ELVDD3, and the low electric potential driving voltage ELVSS is a direct current ("DC") voltage. The first high electric potential driving voltage ELVDD1, the second high electric potential driving voltage ELVDD2, the third high electric potential driving voltage ELVDD3, and the low electric potential driving voltage ELVSS respectively have different magnitudes. For example, when the third pixel PX3 is a blue pixel as described above, so as to achieve white balance, of the first high electric potential driving voltage ELVDD1, the second high electric potential driving voltage ELVDD2, the third high electric potential driving voltage ELVDD3 and the low electric potential driving voltage ELVSS, the third high electric potential driving voltage ELVDD3 applied to the third pixel PX3 may have a largest value, the low electric potential driving voltage ELVSS may have a smallest value, and the first high electric potential driving voltage ELVDD1 may have a value less than the value of the third high electric potential driving voltage ELVDD3 and larger than a value of the second high electric potential driving voltage ELVDD2.

In addition, the output voltage of the power supply portion 140 may further include a reference voltage, gamma reference voltages, a gate high voltage, and a gate low voltage.

The gamma reference voltages may be voltages generated by voltage division of the reference voltage. The gamma reference voltages may be analog voltages, which are applied to the data driver 102.

The gate high voltage is a high logic voltage of a gate signal set to be equal to or higher than a threshold voltage of the data switching element Tsw and the gate low voltage is a low logic voltage of the gate signal set to be an off voltage of the data switching element Tsw. The gate high voltage and the gate low voltage are applied to the scan driver 103.

The scan driver 103 generates scan signals according to the scan control signal SCS provided from the timing controller 101 and sequentially applies the scan signals to the plurality of scan lines SL1 to SLi.

The scan driver 103 may include, for example, a shift register which shifts the gate start pulse according to the gate shift clock to generate scan signals. The shift register may include a plurality of switching elements. The switching elements may be formed at a non-display area of the display panel 110 through substantially the same process as a process through which the data switching element Tsw and the driving switching element Tdr at a display area of the display panel 110 are formed.

The data driver 102 receives the image data signals DATA' and the data control signals DCS from the timing controller 101. The data driver 102 samples the image data signals DATA' according to the data control signal DCS, sequentially latches the sampling image data signals corresponding to one horizontal line in each horizontal period and substantially simultaneously applies the latched image data signals to the data lines DL1 to DLj.

For example, the data driver 102 converts the image data signals DATA' applied from the timing controller 101 into analog image data signals using the gamma reference voltages input from the power supply portion 140 and applies the analog image data signals to the data lines DL1 to DLj.

The data driver 102 may include a gray level generator, which generates a plurality of gray level voltages using the gamma reference voltages applied from the power supply portion 140. The data driver 102 converts the image data signals DATA' applied from the timing controller 101 into analog signals using the gray level voltages.

In an exemplary embodiment, the gray level generator may be located inside or outside the data driver 102.

Figure 3:
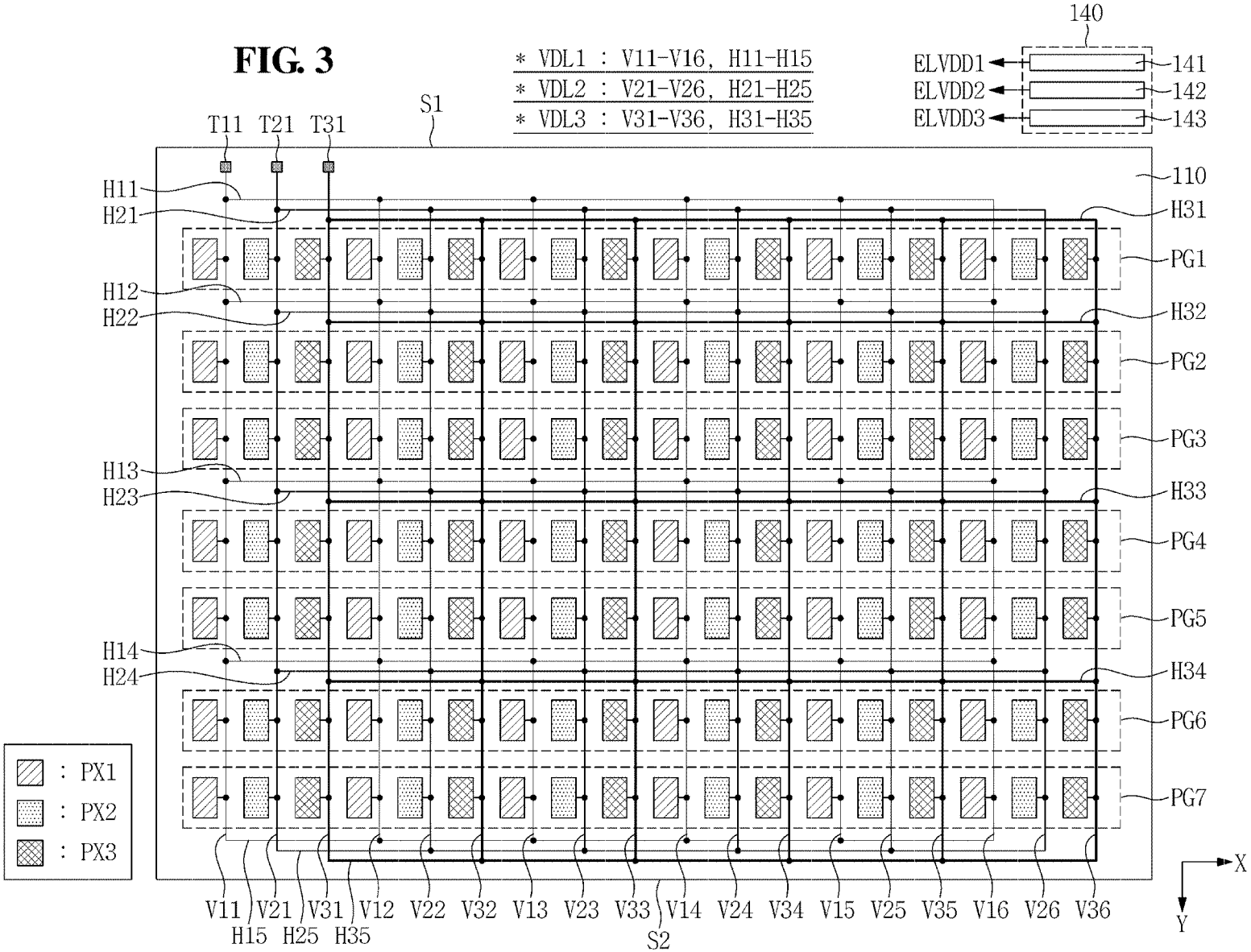
FIG. 3 is a view illustrating an exemplary embodiment of a connection relationship between pixels and a power supply portion of FIG. 1.

FIG. 3 is a view illustrating an exemplary embodiment of a connection relationship between pixels and the power supply portion of FIG. 1.

As described above, the power supply portion 140 outputs high electric potential driving voltages having different magnitudes. In other words, the power supply portion 140 outputs the first high electric potential driving voltage ELVDD1, the second high electric potential driving voltage ELVDD2, and the third high electric potential driving voltage ELVDD3. To this end, the power supply portion 140 includes a first power supply portion 141 outputting the first high electric potential driving voltage ELVDD1, a second power supply portion 142 outputting the second high electric potential driving voltage ELVDD2, and a third power supply portion 143 outputting the third high electric potential driving voltage ELVDD3.

The first high electric potential driving voltage ELVDD1 applied from the first power supply portion 141 is applied to the first pixels PX1 through a first power supply line VDL1. To this end, the first pixels PX1 of the display panel 110 are commonly connected to the first power supply line VDL1 and the first power supply line VDL1 is connected to the first power supply portion 141. The first power supply portion 141 outputs the first high electric potential driving voltage ELVDD1 through an output terminal of the first power supply portion 141 and the output terminal of the first power supply portion 141 is connected to the first power supply line VDL1.

The first power supply line VDL1 is located at the display panel 110. The first power supply line VDL1 may include at least one first main supply line and at least one first auxiliary supply line. For example, as illustrated in FIG. 3, the first power supply line VDL1 may include six first main supply lines V11, V12, V13, V14, V15, and V16 and five first auxiliary supply lines H11, H12, H13, H14, and H15.

At least one first main supply line and at least one first auxiliary supply line are connected to each other. For example, the first main supply lines V11, V12, V13, V14, V15, and V16 and the first auxiliary supply lines H11, H12, H13, H14, and H15 may be unitary.

Each of the first main supply lines V11, V12, V13, V14, V15, and V16 extends in the Y-axis direction. The first main supply lines V11, V12, V13, V14, V15, and V16 are arranged along the X-axis direction. Each of the first auxiliary supply lines H11, H12, H13, H14, and H15 extends in the X-axis direction. The first auxiliary supply lines H11, H12, H13, H14, and H15 are arranged along the Y-axis direction. At least one first main supply line and at least one first auxiliary supply line cross each other. Said at least one first main supply line and said at least one first auxiliary supply line may be connected to each other at their crossing points.

Assuming that the display panel 110 includes seven pixel groups PG1, PG2, PG3, PG4, PG5, PG6, and PG7 as illustrated in FIG. 3, for ease of descriptions, the first, second, third, fourth, fifth, sixth and seven pixel groups PG1, PG2, PG3, PG4, PG5, PG6, and PG7 are arranged sequentially from an upper side of the display panel 110 along the Y-axis direction. In such an exemplary embodiment, the first auxiliary supply lines H12, H13, and H14 are located between a p-th pixel group and a (p+1)-th pixel group which are adjacent to each other in the Y-axis direction, where p is either an odd number or an even number. For example, when p is an odd number, the first auxiliary supply lines H12, H13, and H14 are located between a (2q−1)-th pixel group and a 2q-th pixel group which are adjacent to each other in the Y-axis direction, where q is a natural number. As a more specific example, when p is an odd number, as illustrated in FIG. 3, the first auxiliary supply lines H12, H13, and H14 are located between the first pixel group PG1 and the second pixel group PG2 which are adjacent to each other, between the third pixel group PG3 and the fourth pixel group PG4 which are adjacent to each other and between the fifth pixel group PG5 and the sixth pixel group PG6 which are adjacent to each other, respectively.

In an exemplary embodiment, when p is an odd number as described above, the first auxiliary supply lines H12, H13, and H14 are not located between the 2q-th pixel group and a (2q+1)-th pixel group. For example, as illustrated in FIG. 3, the first auxiliary supply lines H12, H13, and H14 each are not located between the second pixel group PG2 and the third pixel group PG3 which are adjacent to each other, between the fourth pixel group PG4 and the fifth pixel group PG5 which are adjacent to each other and between the sixth pixel group PG6 and the seventh pixel group PG7 which are adjacent to each other.

In an exemplary embodiment, at least one of the first auxiliary supply lines H11, H12, H13, H14, and H15 may be located between an upper edge S1 of the display panel 110 and a pixel group closest to the upper edge S1. For example, as illustrated in FIG. 3, one of the first auxiliary supply lines, e.g., the first auxiliary supply line H11, may be located between the upper edge S1 of the display panel 110 and the first pixel group PG1. In an exemplary embodiment, the first auxiliary supply line H11 located between the upper edge S1 of the display panel 110 and the first pixel group PG1 may be omitted.

In addition, at least one of the first auxiliary supply lines H11, H12, H13, H14, and H15 may be located between a lower edge S2 of the display panel 110 and a pixel group closest to the lower edge S2. For example, as illustrated in FIG. 3, one of the first auxiliary supply lines, e.g., the first auxiliary supply line H15, may be located between the lower edge S2 of the display panel 110 and the seventh pixel group PG7. The lower edge S2 of the display panel 110 faces the upper edge S1 of the display panel 110 described above. In an exemplary embodiment, the first auxiliary supply line H15 located between the lower edge S2 of the display panel 110 and the seventh pixel group PG7 may be omitted.

When p is an even number, the first auxiliary supply lines are located between the 2q-th pixel group and the (2q+1)-th pixel group which are adjacent to each other in the Y-axis direction, where q is a natural number. In a more specific example, when p is an even number, the first auxiliary supply lines are located between the second pixel group PG2 and the third pixel group PG3 which are adjacent to each other, between the fourth pixel group PG4 and the fifth pixel group PG5 which are adjacent to each other and between the sixth pixel group PG6 and the seventh pixel group PG7 which are adjacent to each other, respectively.

In an exemplary embodiment, when p is an even number as described above, the first auxiliary supply lines are not located between the (2q−1)-th pixel group and the 2q-th pixel group which are adjacent to each other. For example, the first auxiliary supply lines each are not located between the first pixel group PG1 and the second pixel group PG2 which are adjacent to each other, between the third pixel group PG3 and the fourth pixel group PG4 which are adjacent to each other and between the fifth pixel group PG5 and the sixth pixel group PG6 which are adjacent to each other.

The first power supply portion 141 directly applies the first high electric potential driving voltage ELVDD1 to at least one of the first main supply lines V11, V12, V13, V14, V15, and V16 and the first auxiliary supply lines H11, H12, H13, H14, and H15 included in the first power supply line VDL1. For example, one side end portion T11 of one of the first main supply lines V11 may be directly connected to the output terminal of the first power supply portion 141.

The second high electric potential driving voltage ELVDD2 applied from the second power supply portion 142 is applied to the second pixels PX2 through a second power supply line VDL2. To this end, the second pixels PX2 of the display panel 110 are commonly connected to the second power supply line VDL2 and the second power supply line VDL2 is connected to the second power supply portion 142. The second power supply portion 142 outputs the second high electric potential driving voltage ELVDD2 through an output terminal of the second power supply portion 142 and the output terminal of the second power supply portion 142 is connected to the second power supply line VDL2.

The second power supply line VDL2 is located at the display panel 110. The second power supply line VDL2 may include at least one second main supply line and at least one second auxiliary supply line. For example, as illustrated in FIG. 3, the second power supply line VDL2 may include six second main supply lines V21, V22, V23, V24, V25, and V26 and five second auxiliary supply lines H21, H22, H23, H24, and H25.

At least one second main supply line and at least one second auxiliary supply line are connected to each other. For example, the second main supply lines V21, V22, V23, V24, V25 and V26 and the second auxiliary supply lines H21, H22, H23, H24, and H25 may be unitary.

Each of the second main supply lines V21, V22, V23, V24, V25, and V26 extends in the Y-axis direction. The second main supply lines V21, V22, V23, V24, V25, and V26 are arranged along the X-axis direction. Each of the second auxiliary supply lines H21, H22, H23, H24, and H25 extends in the X-axis direction. The second auxiliary supply lines H21, H22, H23, H24, and H25 are arranged along the Y-axis direction. At least one second main supply line and at least one second auxiliary supply line cross each other. Said at least one second main supply line and said at least one second auxiliary supply line may be connected to each other at their crossing points.

The second auxiliary supply lines H22, H23, and H24 are located between the p-th pixel group and the (p+1)-th pixel group which are adjacent to each other in the Y-axis direction, where p is either an odd number or an even number. For example, when p is an odd number, the second auxiliary supply lines H22, H23, and H24 are located between the (2q−1)-th pixel group and the 2q-th pixel group which are adjacent to each other in the Y-axis direction. As a more specific example, when p is an odd number, as illustrated in FIG. 3, the second auxiliary supply lines H22, H23, and H24 are located between the first pixel group PG1 and the second pixel group PG2 which are adjacent to each other, between the third pixel group PG3 and the fourth pixel group PG4 which are adjacent to each other and between the fifth pixel group PG5 and the sixth pixel group PG6 which are adjacent to each other, respectively.

In an exemplary embodiment, when p is an odd number as described above, the second auxiliary supply lines H22, H23, and H24 are not located between the 2q-th pixel group and the (2q+1)-th pixel group which are adjacent to each other. For example, as illustrated in FIG. 3, the second auxiliary supply lines H22, H23, and H24 each are not located between the second pixel group PG2 and the third pixel group PG3 which are adjacent to each other, between the fourth pixel group PG4 and the fifth pixel group PG5 which are adjacent to each other and between the sixth pixel group PG6 and the seventh pixel group PG7 which are adjacent to each other, respectively.

In an exemplary embodiment, at least one of the second auxiliary supply lines H21, H22, H23, H24, and H25 may be located between the upper edge S1 of the display panel 110 and a pixel group closest to the upper edge S1. For example, as illustrated in FIG. 3, one of the second auxiliary supply lines, e.g., the second auxiliary supply line H21, may be located between the upper edge S1 of the display panel 110 and the first pixel group PG1. In an exemplary embodiment, the second auxiliary supply line H21 located between the upper edge S1 of the display panel 110 and the first pixel group PG1 may be omitted.

In addition, at least one of the second auxiliary supply lines H21, H22, H23, H24, and H25 may be located between the lower edge S2 of the display panel 110 and a pixel group closest to the lower edge S2. For example, as illustrated in FIG. 3, one of the second auxiliary supply lines, e.g., the second auxiliary supply line H25, may be located between the lower edge S2 of the display panel 110 and the seventh pixel group PG7. In an exemplary embodiment, the second auxiliary supply line H25 located between the lower edge S2 of the display panel 110 and the seventh pixel group PG7 may be omitted.

When p is an even number, the second auxiliary supply lines are located between the 2q-th pixel group and the (2q+1)-th pixel group which are adjacent to each other in the Y-axis direction. As a more specific example, when p is an even number, the second auxiliary supply lines are located between the second pixel group PG2 and the third pixel group PG3 which are adjacent to each other, between the fourth pixel group PG4 and the fifth pixel group PG5 which are adjacent to each other and between the sixth pixel group PG6 and the seventh pixel group PG7 which are adjacent to each other, respectively.

In an exemplary embodiment, when p is an even number as described above, the second auxiliary supply lines are not located between the (2q−1)-th pixel group and the 2q-th pixel group which are adjacent to each other in the Y-axis direction. For example, the second auxiliary supply lines each are not located between the first pixel group PG1 and the second pixel group PG2 which are adjacent to each other, between the third pixel group PG3 and the fourth pixel group PG4 which are adjacent to each other and between the fifth pixel group PG5 and the sixth pixel group PG6 which are adjacent to each other.

The second power supply portion 142 directly applies the second high electric potential driving voltage ELVDD2 to at least one of the second main supply lines V21, V22, V23, V24, V25, and V26 and the second auxiliary supply lines H21, H22, H23, H24, and H25 included in the second power supply line VDL2. For example, one side end portion T21 of one of the second main supply lines V21 may be directly connected to the output terminal of the second power supply portion 142.

The third high electric potential driving voltage ELVDD3 applied from the third power supply portion 143 is applied to the third pixels PX3 through a third power supply line VDL3. To this end, the third pixels PX3 of the display panel 110 are commonly connected to the third power supply line VDL3 and the third power supply line VDL3 is connected to the third power supply portion 143. The third power supply portion 143 outputs the third high electric potential driving voltage ELVDD3 through an output terminal of third power supply portion 143 and the output terminal of the third power supply portion 143 is connected to the third power supply line VDL3.

The third power supply line VDL3 is located at the display panel 110. The third power supply line VDL3 may include at least one third main supply line and at least one third auxiliary supply line. For example, as illustrated in FIG. 3, the third power supply line VDL3 may include six third main supply lines V31, V32, V33, V34, V35, and V36 and five third auxiliary supply lines H31, H32, H33, H34, and H35.

At least one third main supply line and at least one third auxiliary supply line are connected to each other. For example, the third main supply lines V31, V32, V33, V34, V35, and V36 and the third auxiliary supply lines H31, H32, H33, H34, and H35 may be unitary.

Each of the third main supply lines V31, V32, V33, V34, V35, and V36 extends in the Y-axis direction. The third main supply lines V31, V32, V33, V34, V35, and V36 are arranged along the X-axis direction. Each of the third auxiliary supply lines H31, H32, H33, H34, and H35 extends in the X-axis direction. The third auxiliary supply lines H31, H32, H33, H34, and H35 are arranged along the Y-axis direction. At least one third main supply line and at least one third auxiliary supply line cross each other. Said at least one third main supply line and said at least one third auxiliary supply line may be connected to each other at their crossing points.

The third auxiliary supply lines H32, H33, and H34 are located between the p-th pixel group and the (p+1)-th pixel group which are adjacent to each other in the Y-axis direction, where p is either an odd number or an even number. For example, when p is an odd number, the third auxiliary supply lines H32, H33, and H34 are located between the (2q−1)-th pixel group and the 2q-th pixel group which are adjacent to each other in the Y-axis direction. As a more specific example, when p is an odd number, as illustrated in FIG. 3, the third auxiliary supply lines H32, H33, and H34 are located between the first pixel group PG1 and the second pixel group PG2 which are adjacent to each other, between the third pixel group PG3 and the fourth pixel group PG4 which are adjacent to each other and between the fifth pixel group PG5 and the sixth pixel group PG6 which are adjacent to each other, respectively.

In an exemplary embodiment, when p is an odd number as described above, the third auxiliary supply lines H32, H33, and H34 are not located between the 2q-th pixel group and the (2q+1)-th pixel group which are adjacent to each other along the Y-axis direction. For example, as illustrated in FIG. 3, the third auxiliary supply lines H32, H33 and H34 each are not located between the second pixel group PG2 and the third pixel group PG3 which are adjacent to each other, between the fourth pixel group PG4 and the fifth pixel group PG5 which are adjacent to each other and between the sixth pixel group PG6 and the seventh pixel group PG7 which are adjacent to each other, respectively.

In an exemplary embodiment, at least one of the third auxiliary supply lines H31, H32, H33, H34, and H35 may be located between the upper edge S1 of the display panel 110 and a pixel group closest to the upper edge S1. For example, as illustrated in FIG. 3, one of the third auxiliary supply lines, e.g., the third auxiliary supply line H31, may be located between the upper edge S1 of the display panel 110 and the first pixel group PG1. In an exemplary embodiment, the third auxiliary supply line H31 located between the upper edge S1 of the display panel 110 and the first pixel group PG1 may be omitted.

In addition, at least one of the third auxiliary supply lines H31, H32, H33, H34 and H35 may be located between the lower edge S2 of the display panel 110 and a pixel group closest to the lower edge S2. For example, as illustrated in FIG. 3, one of the third auxiliary supply lines, e.g., the third auxiliary supply line H35, may be located between the lower edge S2 of the display panel 110 and the seventh pixel group PG7. In an exemplary embodiment, the third auxiliary supply line H35 located between the lower edge S2 of the display panel 110 and the seventh pixel group PG7 may be omitted.

When p is an even number, the third auxiliary supply lines are located between the 2q-th pixel group and the (2q+1)-th pixel group which are adjacent to each other in the Y-axis direction. In a more specific example, when p is an even number, the third auxiliary supply lines are located between the second pixel group PG2 and the third pixel group PG3 which are adjacent to each other, between the fourth pixel group PG4 and the fifth pixel group PG5 which are adjacent to each other and between the sixth pixel group PG6 and the seventh pixel group PG7 which are adjacent to each other, respectively.

In an exemplary embodiment, when p is an even number as described above, the third auxiliary supply lines are not located between the (2q−1)-th pixel group and the 2q-th pixel group which are adjacent to each other in the Y-axis direction. For example, the third auxiliary supply lines are not located between the first pixel group PG1 and the second pixel group PG2 which are adjacent to each other, between the third pixel group PG3 and the fourth pixel group PG4 which are adjacent to each other and between the fifth pixel group PG5 and the sixth pixel group PG6 which are adjacent to each other.

The third power supply portion 143 directly applies the third high electric potential driving voltage ELVDD3 to at least one of the third main supply lines V31, V32, V33, V34, V35, and V36 and the third auxiliary supply lines H31, H32, H33, H34, and H35 included in the third power supply line VDL3. For example, one side end portion T31 of one of the third main supply lines V31 may be directly connected to the output terminal of the third power supply portion 143.

The first pixel PX1, which is a red pixel, includes a red light emitting element, the second pixel PX2, which is a green pixel, includes a green light emitting element, and the third pixel PX3, which is a blue pixel, includes a blue light emitting element. The red light emitting element, the green light emitting element and the blue light emitting element have different light emitting efficiencies. This is because the characteristics of light emitting materials forming the red light emitting element, the green light emitting element and the blue light emitting element are different from each other. According to the structure of FIG. 3, the first high electric potential driving voltage ELVDD1, the second high electric potential driving voltage ELVDD2, and the third high electric potential driving voltage ELVDD3 having different magnitudes are respectively applied to the first pixel PX1, the second pixel PX3, and the third pixel PX3 having different colors. Accordingly, respective luminances of the first pixel PX1, the second pixel PX2, and the third pixel PX3 are correctly corrected, such that a white balance of the pixels may be correctly maintained.

In addition, according to the structure of FIG. 3, since the auxiliary supply lines are not located at some of areas between adjacent pixel groups, the light emitting display device according to an exemplary embodiment may have high space utilization. That is, an area that is not occupied by the auxiliary supply lines may be utilized as a space for other additional elements, e.g., sensing elements.

Other exemplary embodiments to be described below may have excellent white balance and high space utilization as described above.

Figure 4:
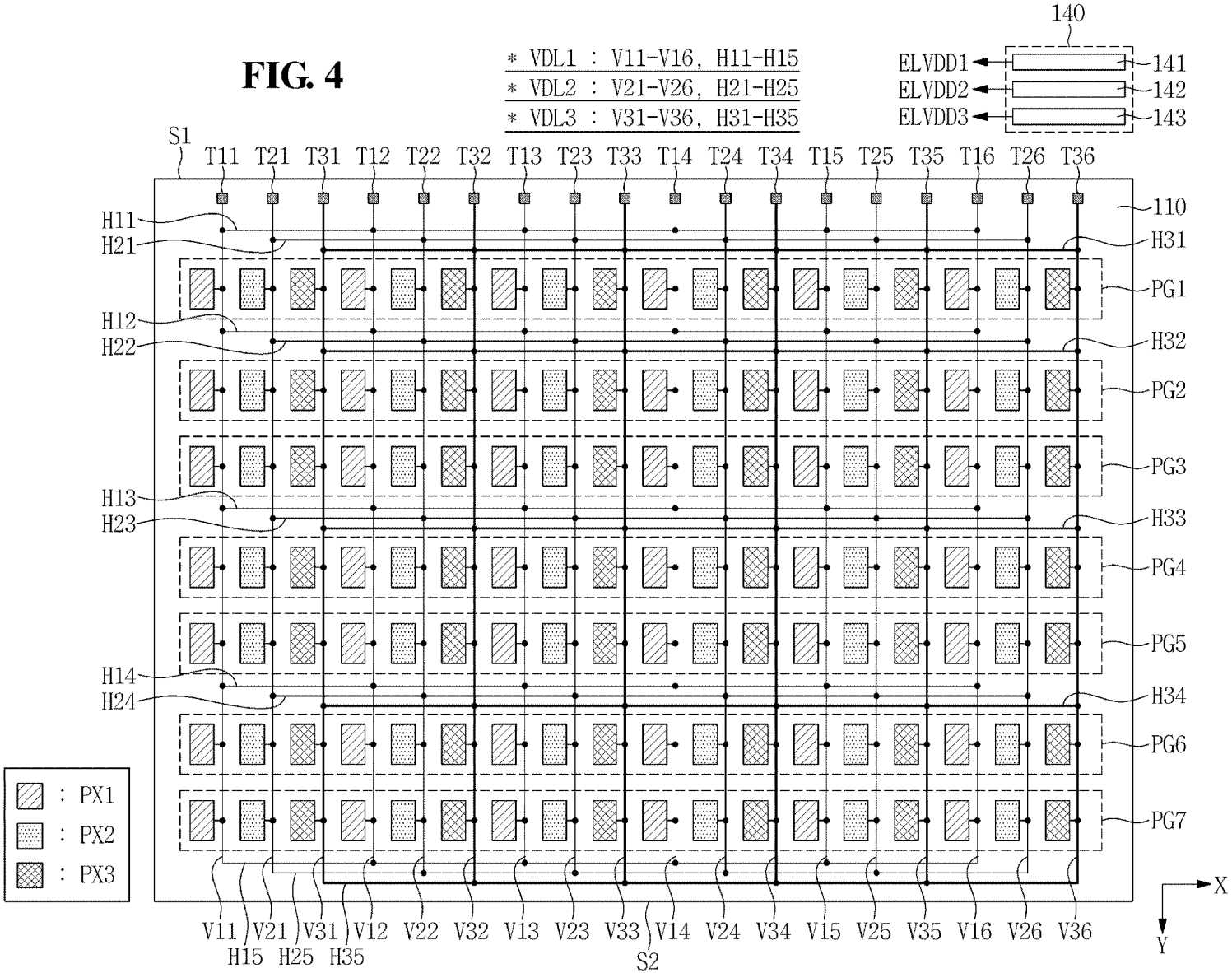
FIG. 4 is a view illustrating an alternative exemplary embodiment of a connection relationship between the pixels and the power supply portion of FIG. 1.

FIG. 4 is a view illustrating an alternative exemplary embodiment of a connection relationship between the pixels and the power supply portion of FIG. 1.

As a first power supply line VDL1, a second power supply line VDL2, and a third power supply line VDL3 illustrated in FIG. 4 have substantially same structures as those of the first power supply line VDL1, the second power supply line VDL2, and the third power supply line VDL3 illustrated in FIG. 3, respectively, the first power supply line VDL1, the second power supply line VDL2, and the third power supply line VDL3 illustrated in FIG. 4 will make reference to FIG. 3 and the related descriptions, and further description thereof may be omitted.

A first power supply portion 141 of FIG. 4 may directly apply a first high electric potential driving voltage ELVDD1 to all first main supply lines V11, V12, V13, V14, V15, and V16 included in the first power supply line VDL1. For example, one side end portions T11, T12, T13, T14, T15, and T16 of respective corresponding ones of the first main supply lines V11, V12, V13, V14, V15, and V16 are directly connected to an output terminal of the first power supply portion 141. In such an exemplary embodiment, the number of output terminals of the first power supply portion 141 may be 1. Alternatively, the number of output terminals of the first power supply portion 141 may be substantially equal to the number of said respective one side end portions of the first main supply lines V11, V12, V13, V14, V15, and V16. In other words, when the number of output terminals of the first power supply portion 141 is a and the number of said respective one side end portions of the first main supply lines V11, V12, V13, V14, V15, and V16 is b, a may be equal to b.

The second power supply portion 142 of FIG. 4 may directly apply a second high electric potential driving voltage ELVDD2 to all second main supply lines V21, V22, V23, V24, V25, and V26 included in the second power supply line VDL2. For example, one side end portions T21, T22, T23, T24, T25, and T26 of respective corresponding ones of the second main supply lines V21, V22, V23, V24, V25, and V26 are directly connected to an output terminal of the second power supply portion 142. In such an exemplary embodiment, the number of output terminals of the second power supply portion 142 may be 1. Alternatively, the number of output terminals of the second power supply portion 142 may be substantially equal to the number of said respective one side end portions of the second main supply lines V21, V22, V23, V24, V25, and V26. In other words, when the number of output terminals of the second power supply portion 142 is a and the number of said respective one side end portions of the second main supply lines V21, V22, V23, V24, V25, and V26 is b, a may be equal to b.

The third power supply portion 143 of FIG. 4 may directly apply a third high electric potential driving voltage ELVDD3 to all third main supply lines V31, V32, V33, V34, V35, and V36 included in the third power supply line VDL3. For example, one side end portions T31, T32, T33, T34, T35, and T36 of respective corresponding ones of the third main supply lines V31, V32, V33, V34, V35, and V36 are directly connected to an output terminal of the third power supply portion 143. In such an exemplary embodiment, the number of output terminals of the third power supply portion 143 may be 1. Alternatively, the number of output terminals of the third power supply portion 143 may be substantially equal to the number of said respective one side end portions of the third main supply lines V31, V32, V33, V34, V35, and V36. In other words, when the number of output terminals of the third power supply portion 143 is a and the number of said respective one side end portions of the third main supply lines V31, V32, V33, V34, V35, and V36 is b, a may be equal to b.

Figure 5:
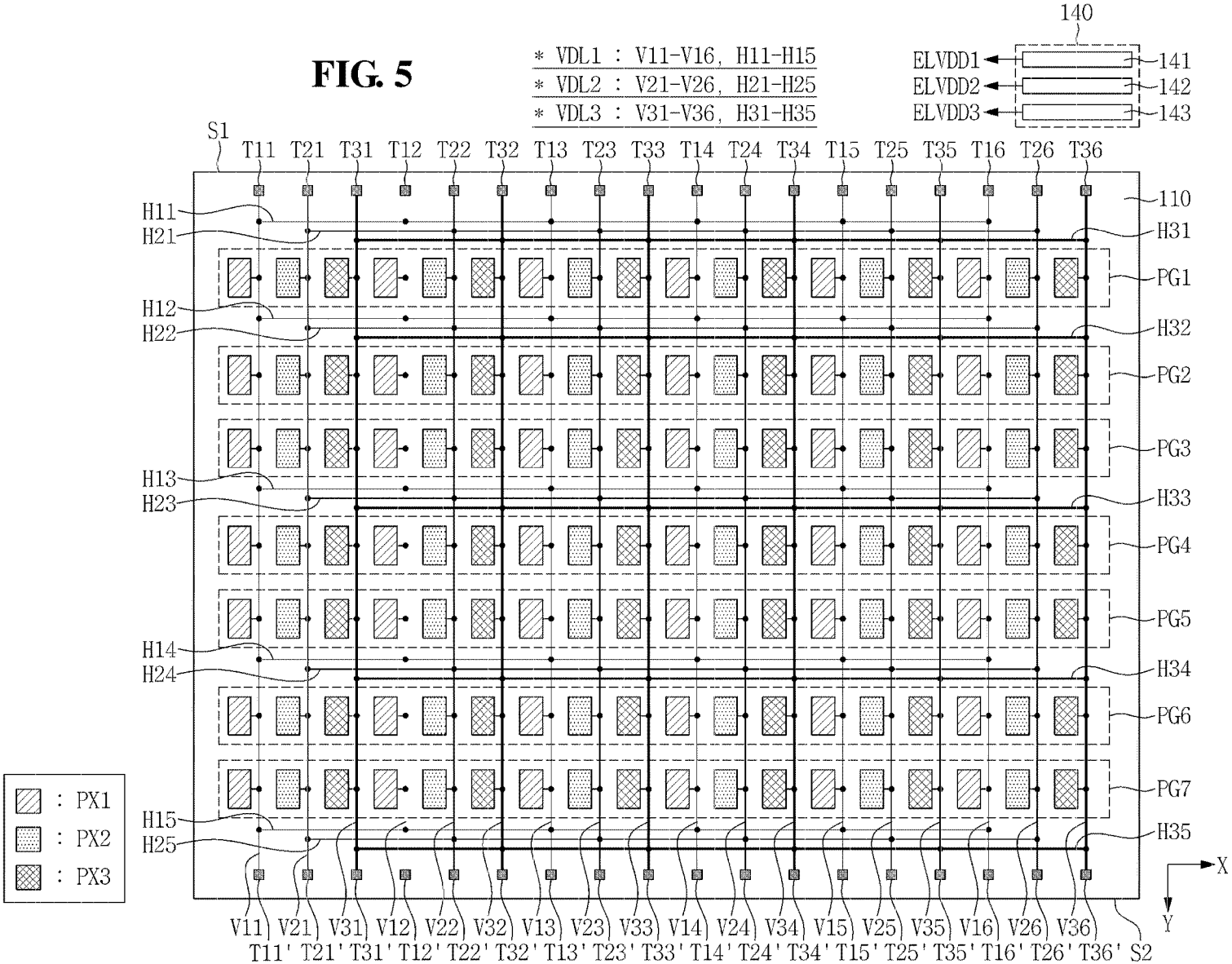
FIG. 5 is a view illustrating another alternative exemplary embodiment of a connection relationship between the pixels and the power supply portion of FIG. 1.

FIG. 5 is a view illustrating another alternative exemplary embodiment of a connection relationship between the pixels and the power supply portion of FIG. 1.

As a first power supply line VDL1, a second power supply line VDL2, and a third power supply line VDL3 illustrated in FIG. 5 have substantially same structures as those of the first power supply line VDL1, the second power supply line VDL2, and the third power supply line VDL3 illustrated in FIG. 3, respectively, the first power supply line VDL1, the second power supply line VDL2, and the third power supply line VDL3 illustrated in FIG. 5 will make reference to FIG. 3 and the related descriptions, and further description thereof may be omitted.

A first power supply portion 141 of FIG. 5 may directly apply a first high electric potential driving voltage ELVDD1 to all first main supply lines V11, V12, V13, V14, V15, and V16 included in the first power supply line VDL1. For example, one side end portions T11, T12, T13, T14, T15, and T16 of respective corresponding ones of the first main supply lines V11, V12, V13, V14, V15, and V16 are directly connected to an output terminal of the first power supply portion 141, and another side end portions T11', T12', T13', T14', T15', and T16' of respective corresponding ones of the first main supply lines V11, V12, V13, V14, V15, and V16 are directly connected to the output terminal of the first power supply portion 141. In such an exemplary embodiment, the number of output terminals of the first power supply portion 141 may be 1. Alternatively, the number of output terminals of the first power supply portion 141 may be substantially equal to the total of the number of said respective one side end portions and said respective another side end portions of the first main supply lines V11, V12, V13, V14, V15, and V16. In other words, when the number of output terminals of the first power supply portion 141 is a, the number of said respective one side end portions of the first main supply lines V11, V12, V13, V14, V15, and V16 is b, and the number of said respective another side end portions of the first main supply lines V11, V12, V13, V14, V15, and V16 is c, a may be equal to a sum of b and c, which is (b+c).

A second power supply portion 142 of FIG. 5 may directly apply a second high electric potential driving voltage ELVDD2 to all second main supply lines V21, V22, V23, V24, V25, and V26 included in the second power supply line VDL2. For example, one side end portions T21, T22, T23, T24, T25, and T26 of respective corresponding ones of the second main supply lines V21, V22, V23, V24, V25, and V26 are directly connected to an output terminal of the second power supply portion 142, and another side end portions T21', T22', T23', T24', T25', and T26' of respective corresponding ones of the second main supply lines V21, V22, V23, V24, V25, and V26 are directly connected to the output terminal of the second power supply portion 142. In such an exemplary embodiment, the number of output terminals of the second power supply portion 142 may be 1. Alternatively, the number of output terminals of the second power supply portion 142 may be substantially equal to the total of the number of said respective one side end portions and said respective another side end portions of the second main supply lines V21, V22, V23, V24, V25, and V26. In other words, when the number of output terminals of the second power supply portion 142 is a, the number of said respective one side end portions of the second main supply lines V21, V22, V23, V24, V25, and V26 is b, and the number of said respective another side end portions of the second main supply lines V21, V22, V23, V24, V25, and V26 is c, a may be equal to a sum of b and c, which is (b+c).

A third power supply portion 143 of FIG. 5 may directly apply a third high electric potential driving voltage ELVDD3 to all third main supply lines V31, V32, V33, V34, V35, and V36 included in the third power supply line VDL3. For example, one side end portions T31, T32, T33, T34, T35, and T36 of respective corresponding ones of the third main supply lines V31, V32, V33, V34, V35, and V36 are directly connected to an output terminal of the third power supply portion 143, and another side end portions T31', T32', T33', T34', T35', and T36' of respective corresponding ones of the third main supply lines V31, V32, V33, V34, V35, and V36 are directly connected to the output terminal of the third power supply portion 143. In such an exemplary embodiment, the number of output terminals of the third power supply portion 143 may be 1. Alternatively, the number of output terminals of the third power supply portion 143 may be substantially equal to the total of the number of said respective one side end portions and said respective another side end portions of the third main supply lines V31, V32, V33, V34, V35, and V36. In other words, when the number of output terminals of the third power supply portion 143 is a, the number of said respective one side end portions of the third main supply lines V31, V32, V33, V34, V35, and V36 is b, and the number of said respective another side end portions of the third main supply lines V31, V32, V33, V34, V35, and V36 is c, a may be equal to a sum of b and c, which is (b+c).

Figure 6:
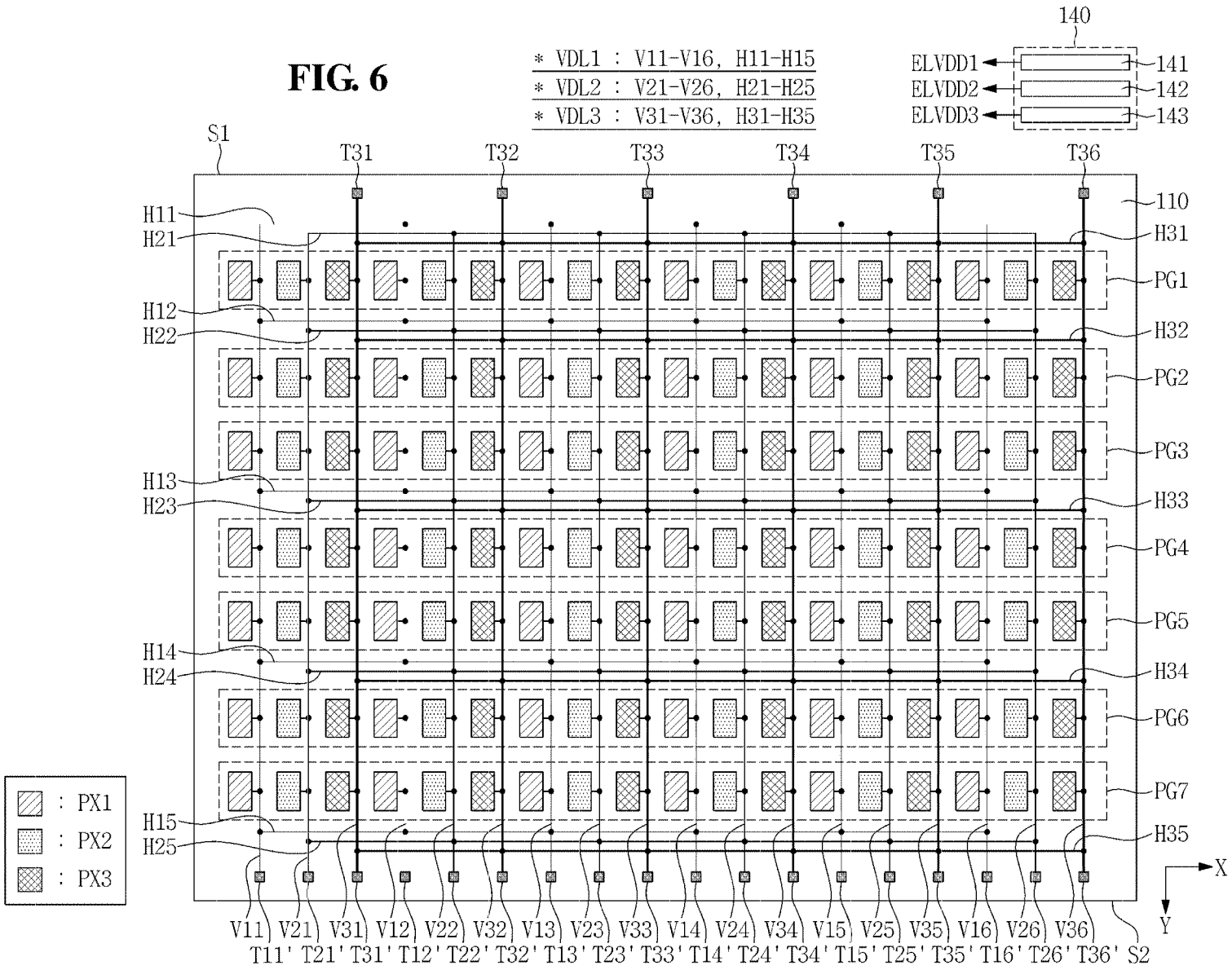
FIG. 6 is a view illustrating another alternative exemplary embodiment of a connection relationship between the pixels and the power supply portion of FIG. 1.

FIG. 6 is a view illustrating another alternative exemplary embodiment of a connection relationship between the pixels and the power supply portion of FIG. 1.

As a first power supply line VDL1, a second power supply line VDL2, and a third power supply line VDL3 illustrated in FIG. 6 have substantially same structures as those of the first power supply line VDL1, the second power supply line VDL2, and the third power supply line VDL3 illustrated in FIG. 3, respectively, the first power supply line VDL1, the second power supply line VDL2, and the third power supply line VDL3 illustrated in FIG. 6 will make reference to FIG. 3 and the related descriptions, and further description thereof may be omitted.

A first power supply portion 141 of FIG. 6 may directly apply a first high electric potential driving voltage ELVDD1 to all first main supply lines V11, V12, V13, V14, V15, and V16 included in the first power supply line VDL1. For example, another side end portions T11', T12', T13', T14', T15', and T16' of respective corresponding ones of the first main supply lines V11, V12, V13, V14, V15, and V16 are directly connected to an output terminal of the first power supply portion 141. In such an exemplary embodiment, the number of output terminals of the first power supply portion 141 may be 1. Alternatively, the number of output terminals of the first power supply portion 141 may be substantially equal to the number of said respective another side end portions of the first main supply lines V11, V12, V13, V14, V15, and V16. In other words, when the number of output terminals of the first power supply portion 141 is a and the number of said respective another side end portions of the first main supply lines V11, V12, V13, V14, V15, and V16 is b, a may be equal to b.

A second power supply portion 142 of FIG. 6 may directly apply a second high electric potential driving voltage ELVDD2 to all second main supply lines V21, V22, V23, V24, V25, and V26 included in the second power supply line VDL2. For example, another side end portions T21', T22', T23', T24', T25', and T26' of respective corresponding ones of the second main supply lines V21, V22, V23, V24, V25, and V26 are directly connected to an output terminal of the second power supply portion 142. In such an exemplary embodiment, the number of output terminals of the second power supply portion 142 may be 1. Alternatively, the number of output terminals of the second power supply portion 142 may be substantially equal to the number of said respective another side end portions of the second main supply lines V21, V22, V23, V24, V25, and V26. In other words, when the number of output terminals of the second power supply portion 142 is a and the number of said respective another side end portions of the second main supply lines V21, V22, V23, V24, V25, and V26 is b, a may be equal to b.

A third power supply portion 143 of FIG. 6 may directly apply a third high electric potential driving voltage ELVDD3 to all third main supply lines V31, V32, V33, V34, V35, and V36 included in the third power supply line VDL3. For example, one side end portions T31, T32, T33, T34, T35, and T36 of respective corresponding ones of the third main supply lines V31, V32, V33, V34, V35, and V36 are directly connected to an output terminal of the third power supply portion 143, and another side end portions T31', T32', T33', T34', T35', and T36' of respective corresponding ones of the third main supply lines V31, V32, V33, V34, V35, and V36 are directly connected to the output terminal of the third power supply portion 143. In such an exemplary embodiment, the number of output terminals of the third power supply portion 143 may be 1. Alternatively, the number of output terminals of the third power supply portion 143 may be substantially equal to the total of the number of said respective one side end portions and said respective another side end portions of the third main supply lines V31, V32, V33, V34, V35, and V36. In other words, when the number of output terminals of the third power supply portion 143 is a, the number of said respective one side end portions of the third main supply lines V31, V32, V33, V34, V35 and V36 is b, and the number of said respective another side end portions of the third main supply lines V31, V32, V33, V34, V35, and V36 is c, a may be equal to a sum of b and c, which is (b+c).

As described above, so as to achieve white balance, a high electric potential driving voltage applied to a blue pixel is higher than another high electric potential driving voltage. In other words, when the third pixel PX3 is a blue pixel, the third high electric potential driving voltage ELVDD3 applied to the third pixel PX3 is higher than another high electric potential driving voltage. Accordingly, a driving current flowing through the third power supply line VDL3 is larger than a driving current flowing through another power supply line. As illustrated in FIG. 6, the third high electric potential driving voltage ELVDD3 is applied to said one side end portions T31, T32, T33, T34, T35, and T36 and said another side end portions T31', T32', T33', T34', T35', and T36' of respective corresponding ones of the third main supply lines V31, V32, V33, V34, V35, and V36 so that the driving current may flow more easily through the third power supply line VDL3.

Figure 7:
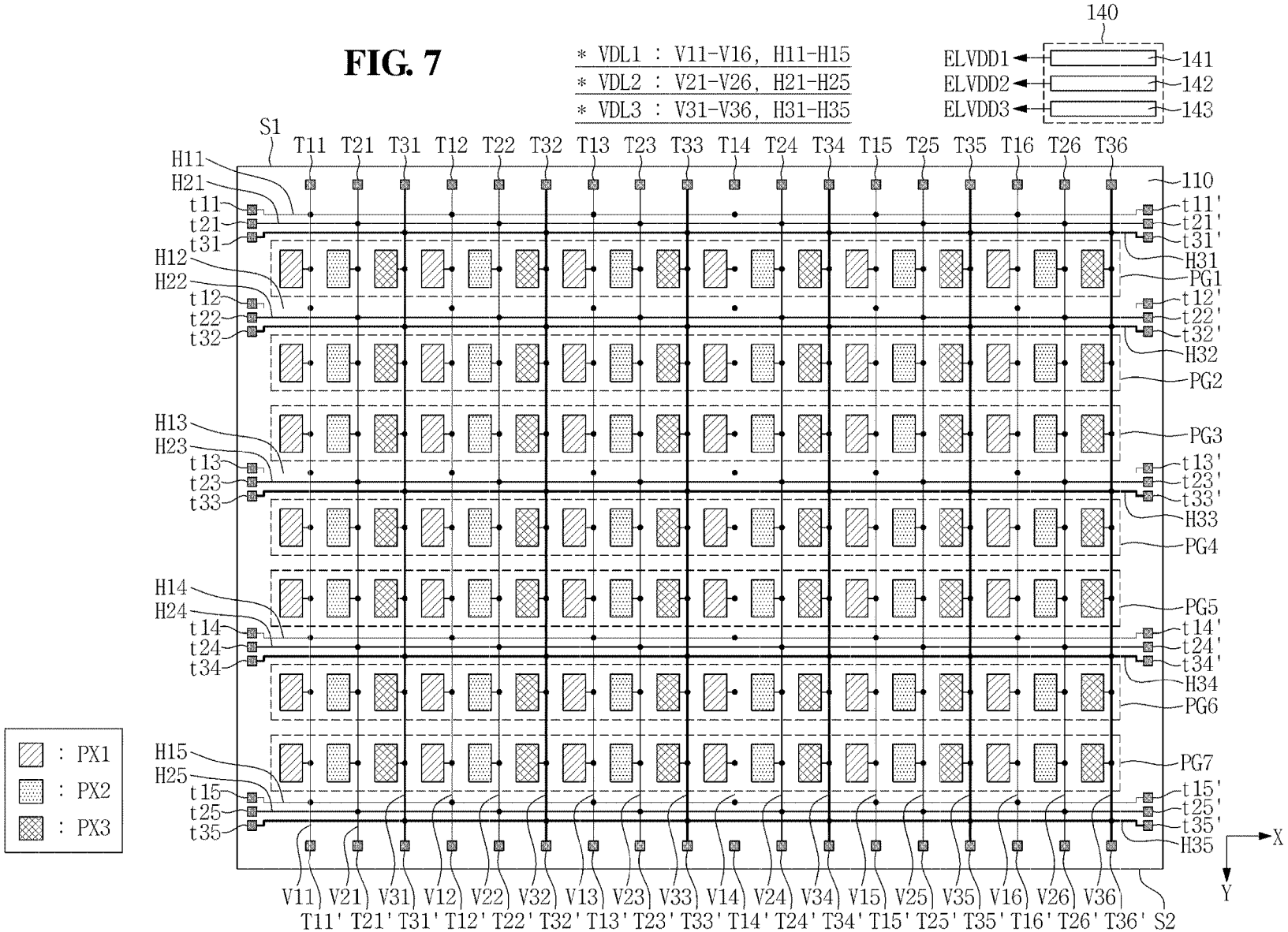
FIG. 7 is a view illustrating another alternative exemplary embodiment of a connection relationship between the pixels and the power supply portion of FIG. 1.

FIG. 7 is a view illustrating another alternative exemplary embodiment of a connection relationship between the pixels and the power supply portion of FIG. 1.

As a first power supply line VDL1, a second power supply line VDL2, and a third power supply line VDL3 illustrated in FIG. 7 have substantially same structures as those of the first power supply line VDL1, the second power supply line VDL2, and the third power supply line VDL3 illustrated in FIG. 3, respectively, the first power supply line VDL1, the second power supply line VDL2, and the third power supply line VDL3 illustrated in FIG. 7 will make reference to FIG. 3 and the related descriptions, and further description thereof may be omitted.

As the connection relationship between first main supply lines V11, V12, V13, V14, V15, and V16 and a first power supply portion 141, the connection relationship between second main supply lines V21, V22, V23, V24, V25, and V26 and a second power supply portion 142, and the connection relationship between third main supply lines V31, V32, V33, V34, V35, and V36 and a third power supply portion 143 illustrated in FIG. 7 are substantially the same as the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 5, the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 7 will make reference to FIG. 5 and the related descriptions, and further description thereof may be omitted.

The first power supply portion 141 of FIG. 7 may directly apply a first high electric potential driving voltage ELVDD1 to all first auxiliary supply lines H11, H12, H13, H14, and H15 included in the first power supply line VDL1. For example, one side end portions t11, t12, t13, t14, and t15 of respective corresponding ones of the first auxiliary supply lines H11, H12, H13, H14, and H15 are directly connected to an output terminal of the first power supply portion 141, and another side end portions t11', t12', t13', t14', and t15' of respective corresponding ones of the first auxiliary supply lines H11, H12, H13, H14, and H15 are directly connected to the output terminal of the first power supply portion 141. In such an exemplary embodiment, the number of output terminals of the first power supply portion 141 may be 1. Alternatively, the number of output terminals of the first power supply portion 141 may be substantially equal to the total of the number of respective one side end portions of the first main supply lines V11, V12, V13, V14, V15, and V16, the number of respective another side end portions of the first main supply lines V11, V12, V13, V14, V15, and V16, the number of said respective one side end portions of the first auxiliary supply lines H11, H12, H13, H14, and H15 and the number of said respective another side end portions of the first auxiliary supply lines H11, H12, H13, H14 and H15. In other words, when the number of output terminals of the first power supply portion 141 is a, the number of said respective one side end portions of the first main supply lines V11, V12, V13, V14, V15, and V16 is b, the number of said respective another side end portions of the first main supply lines V11, V12, V13, V14, V15, and V16 is c, the number of said respective one side end portions of the first auxiliary supply lines H11, H12, H13, H14, and H15 is d, and the number of said respective another side end portions of the first auxiliary supply lines H11, H12, H13, H14, and H15 is e, a may be equal to a sum of b, c, d and e, which is (b+c+d+e).

The second power supply portion 142 of FIG. 7 may directly apply a second high electric potential driving voltage ELVDD2 to all second auxiliary supply lines H21, H22, H23, H24, and H25 included in the second power supply line VDL2. For example, one side end portions t21, t22, t23, t24 and t25 of respective corresponding ones of the second auxiliary supply lines H21, H22, H23, H24, and H25 are directly connected to an output terminal of the second power supply portion 142, and another side end portions t21', t22', t23', t24', and t25' of respective corresponding ones of the second auxiliary supply lines H21, H22, H23, H24, and H25 are directly connected to the output terminal of the second power supply portion 142. In such an exemplary embodiment, the number of output terminals of the second power supply portion 142 may be 1. Alternatively, the number of output terminals of the second power supply portion 142 may be substantially equal to the total of the number of respective one side end portions of the second main supply lines V21, V22, V23, V24, V25, and V26, the number of respective another side end portions of the second main supply lines V21, V22, V23, V24, V25, and V26, the number of said respective one side end portions of the second auxiliary supply lines H21, H22, H23, H24, and H25, and the number of said respective another side end portions of the second auxiliary supply lines H21, H22, H23, H24, and H25. In other words, when the number of output terminals of the second power supply portion 142 is a, the number of said respective one side end portions of the second main supply lines V21, V22, V23, V24, V25, and V26 is b, the number of said respective another side end portions of the second main supply lines V21, V22, V23, V24, V25, and V26 is c, the number of said respective one side end portions of the second auxiliary supply lines H21, H22, H23, H24, and H25 is d, and the number of said respective another side end portions of the second auxiliary supply lines H21, H22, H23, H24, and H25 is e, a may be equal to a sum of b, c, d and e, which is (b+c+d+e).

The third power supply portion 143 of FIG. 7 may directly apply a third high electric potential driving voltage ELVDD3 to all third auxiliary supply lines H31, H32, H33, H34, and H35 included in the third power supply line VDL3. For example, one side end portions t31, t32, t33, t34, and t35 of respective corresponding ones of the third auxiliary supply lines H31, H32, H33, H34, and H35 are directly connected to an output terminal of the third power supply portion 143, and another side end portions t31', t32', t33', t34', and t35' of respective corresponding ones of the third auxiliary supply lines H31, H32, H33, H34, and H35 are directly connected to the output terminal of the third power supply portion 143. In such an exemplary embodiment, the number of output terminals of the third power supply portion 143 may be 1. Alternatively, the number of output terminals of the third power supply portion 143 may be substantially equal to the total of the number of respective one side end portions of the third main supply lines V31, V32, V33, V34, V35, and V36, the number of respective another side end portions of the third main supply lines V31, V32, V33, V34, V35, and V36, the number of said respective one side end portions of the third auxiliary supply lines H31, H32, H33, H34, and H35, and the number of said respective another side end portions of the third auxiliary supply lines H31, H32, H33, H34, and H35. In other words, when the number of output terminals of the third power supply portion 143 is a, the number of said respective one side end portions of the third main supply lines V31, V32, V33, V34, V35, and V36 is b, the number of said respective another side end portions of the third main supply lines V31, V32, V33, V34, V35, and V36 is c, the number of said respective one side end portions of the third auxiliary supply lines H31, H32, H33, H34, and H35 is d, and the number of said respective another side end portions of the third auxiliary supply lines H31, H32, H33, H34, and H35 is e, a may be equal to a sum of b, c, d and e, which is (b+c+d+e).

Figure 8:
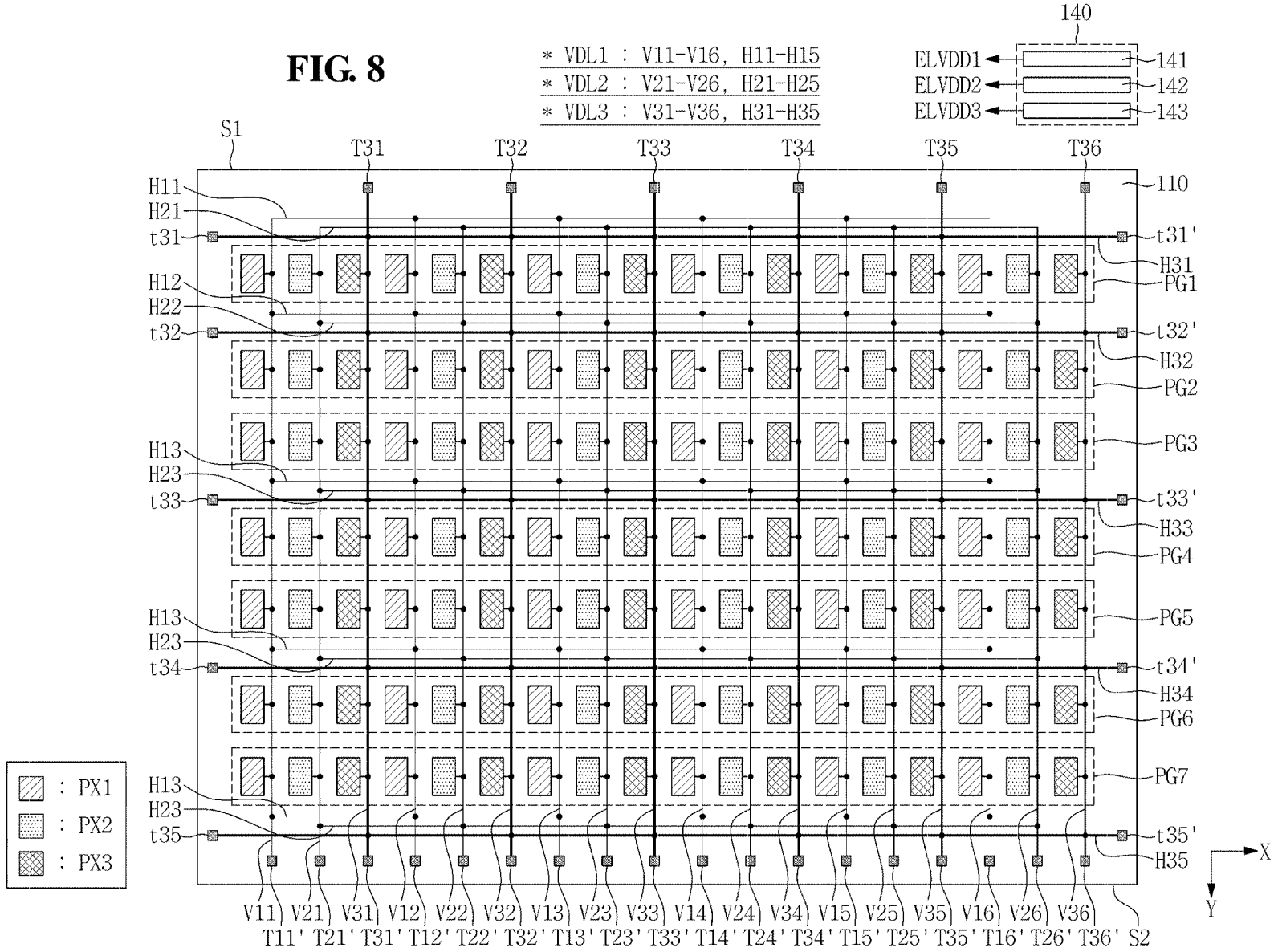
FIG. 8 is a view illustrating another alternative exemplary embodiment of a connection relationship between the pixels and the power supply portion of FIG. 1.

FIG. 8 is a view illustrating another alternative exemplary embodiment of a connection relationship between the pixels and the power supply portion of FIG. 1.

As a first power supply line VDL1, a second power supply line VDL2 and a third power supply line VDL3 illustrated in FIG. 8 have substantially same structures as those of the first power supply line VDL1, the second power supply line VDL2 and the third power supply line VDL3 illustrated in FIG. 3, respectively, the first power supply line VDL1, the second power supply line VDL2 and the third power supply line VDL3 illustrated in FIG. 8 will make reference to FIG. 3 and the related descriptions, and further description thereof may be omitted.

As the connection relationship between first main supply lines V11, V12, V13, V14, V15, and V16 and a first power supply portion 141, the connection relationship between second main supply lines V21, V22, V23, V24, V25, and V26 and a second power supply portion 142, and the connection relationship between third main supply lines V31, V32, V33, V34, V35, and V36 and a third power supply portion 143 illustrated in FIG. 8 are substantially the same as the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 6, the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 8 will make reference to FIG. 6 and the related descriptions, and further description thereof may be omitted.

The third power supply portion 143 of FIG. 8 may directly apply a third high electric potential driving voltage ELVDD3 to all third auxiliary supply lines H31, H32, H33, H34, and H35 included in the third power supply line VDL3. For example, one side end portions t31, t32, t33, t34, and t35 of respective corresponding ones of the third auxiliary supply lines H31, H32, H33, H34, and H35 are directly connected to an output terminal of the third power supply portion 143, and another side end portions t31', t32', t33', t34', and t35' of respective corresponding ones of the third auxiliary supply lines H31, H32, H33, H34, and H35 are directly connected to the output terminal of the third power supply portion 143. In such an exemplary embodiment, the number of output terminals of the third power supply portion 143 may be 1. Alternatively, the number of output terminals of the third power supply portion 143 may be substantially equal to the total of the number of respective one side end portions of the third main supply lines V31, V32, V33, V34, V35, and V36, the number of respective another side end portions of the third main supply lines V31, V32, V33, V34, V35, and V36, the number of said respective one side end portions of the third auxiliary supply lines H31, H32, H33, H34, and H35, and the number of said respective another side end portions of the third auxiliary supply lines H31, H32, H33, H34, and H35. In other words, when the number of output terminals of the third power supply portion 143 is a, the number of said respective one side end portions of the third main supply lines V31, V32, V33, V34, V35, and V36 is b, the number of said respective another side end portions of the third main supply lines V31, V32, V33, V34, V35, and V36 is c, the number of said respective one side end portions of the third auxiliary supply lines H31, H32, H33, H34, and H35 is d, and the number of said respective another side end portions of the third auxiliary supply lines H31, H32, H33, H34, and H35 is e, a may be equal to a sum of b, c, d and e, which is (b+c+d+e).

Figure 9:
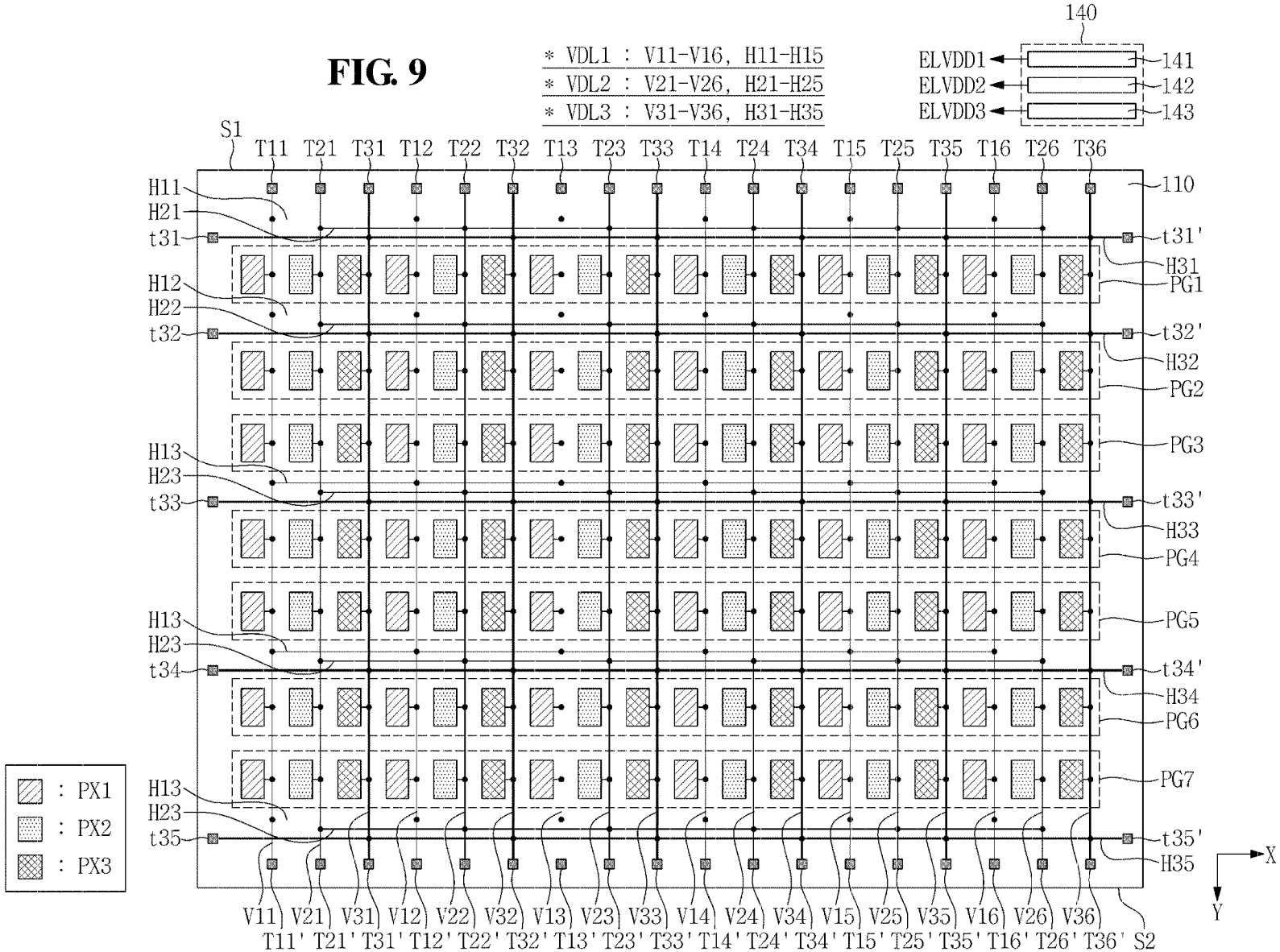
FIG. 9 is a view illustrating another alternative exemplary embodiment of a connection relationship between the pixels and the power supply portion of FIG. 1.

FIG. 9 is a view illustrating another alternative exemplary embodiment of a connection relationship between the pixels and the power supply portion of FIG. 1.

As a first power supply line VDL1, a second power supply line VDL2, and a third power supply line VDL3 illustrated in FIG. 9 have substantially same structures as those of the first power supply line VDL1, the second power supply line VDL2, and the third power supply line VDL3 illustrated in FIG. 3, respectively, the first power supply line VDL1, the second power supply line VDL2, and the third power supply line VDL3 illustrated in FIG. 9 will make reference to FIG. 3 and the related descriptions, and further description thereof may be omitted.

As the connection relationship between first main supply lines V11, V12, V13, V14, V15, and V16 and a first power supply portion 141, the connection relationship between second main supply lines V21, V22, V23, V24, V25, and V26 and a second power supply portion 142, and the connection relationship between third main supply lines V31, V32, V33, V34, V35, and V36 and a third power supply portion 143 illustrated in FIG. 9 are substantially the same as the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 5, the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 9 will make reference to FIG. 5 and the related descriptions, and further description thereof may be omitted.

As the connection relationship between third auxiliary supply lines H31, H32, H33, H34, and H35 and the third power supply portion 143 illustrated in FIG. 9 is substantially the same as the connection relationship between the third auxiliary supply lines H31, H32, H33, H34, and H35 and the third power supply portion 143 illustrated in FIG. 8, the connection relationship between the third auxiliary supply lines H31, H32, H33, H34, and H35 and the third power supply portion 143 illustrated in FIG. 9 will make reference to FIG. 8 and the related descriptions, and further description thereof may be omitted.

Figure 10:
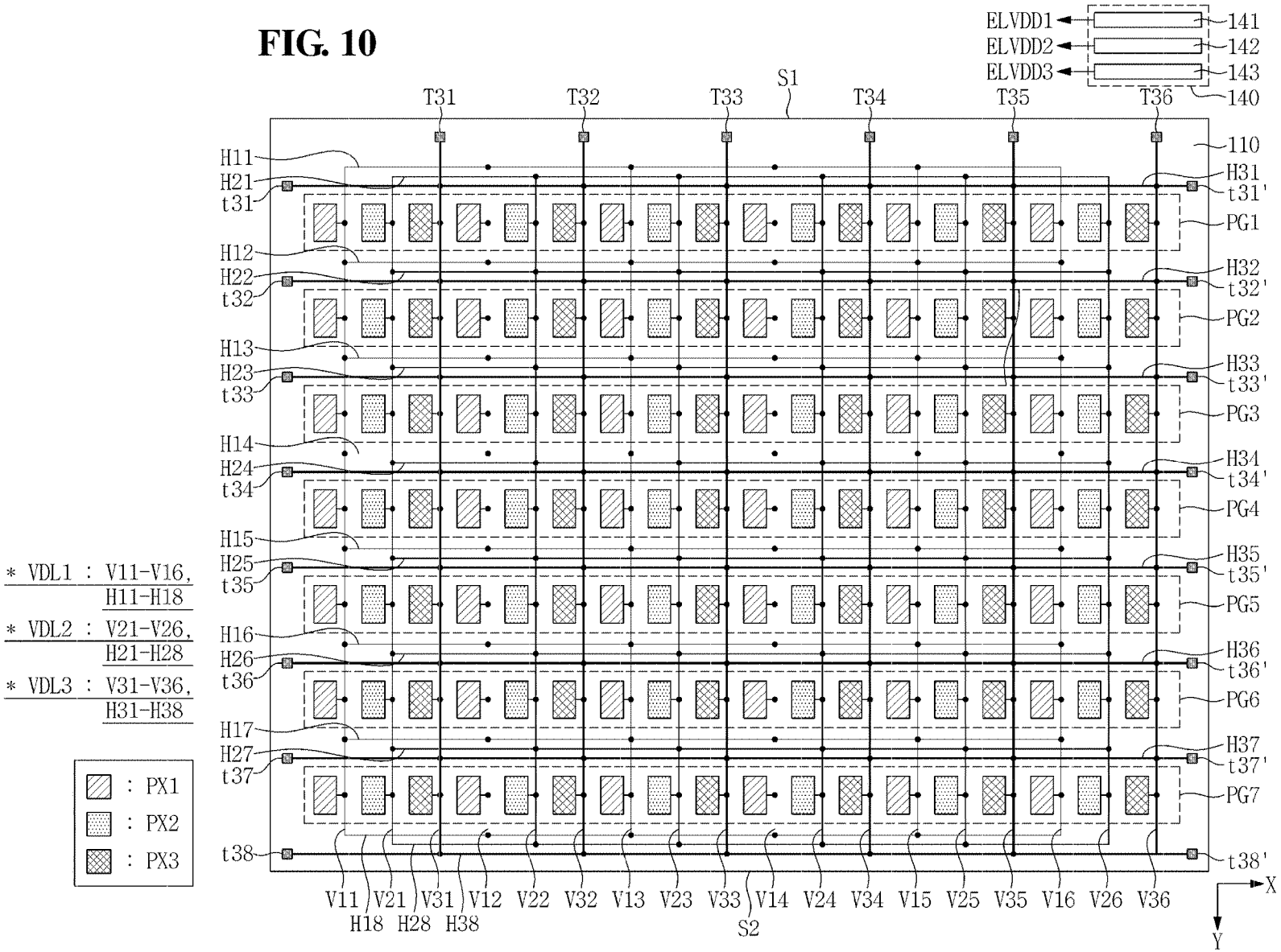
FIG. 10 is a view illustrating another alternative exemplary embodiment of a connection relationship between the pixels and the power supply portion of FIG. 1.

FIG. 10 is a view illustrating another alternative exemplary embodiment of a connection relationship between the pixels and the power supply portion of FIG. 1.

As first main supply lines V11, V12, V13, V14, V15, and V16, second main supply lines V21, V22, V23, V24, V25, and V26, and third main supply lines V31, V32, V33, V34, V35, and V36 illustrated in FIG. 10 have substantially same structures as those of the first main supply lines V11, V12, V13, V14, V15, and V16, the second main supply lines V21, V22, V23, V24, V25, and V26, and the third main supply lines V31, V32, V33, V34, V35, and V36 illustrated in FIG. 3, respectively, the descriptions of the first main supply lines V11, V12, V13, V14, V15, and V16, the second main supply lines V21, V22, V23, V24, V25, and V26, and the third main supply lines V31, V32, V33, V34, V35, and V36 illustrated in FIG. 10 will make reference to FIG. 3 and the related descriptions, and further description thereof may be omitted.

As the connection relationship between first main supply lines V11, V12, V13, V14, V15, and V16 and a first power supply portion 141, the connection relationship between second main supply lines V21, V22, V23, V24, V25, and V26 and a second power supply portion 142, and the connection relationship between third main supply lines V31, V32, V33, V34, V35, and V36 and a third power supply portion 143 illustrated in FIG. 10 are substantially the same as the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 6, the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 illustrated in FIG. 10 will make reference to FIG. 6 and the related descriptions, and further description thereof may be omitted.

As the connection relationship between third auxiliary supply lines H31, H32, H33, H34, H35, H36, H37, and H38 and the third power supply portion 143 illustrated in FIG. 10 is substantially the same as the connection relationship between the third auxiliary supply lines H31, H32, H33, H34, and H35 and the third power supply portion 143 illustrated in FIG. 8, the connection relationship between the third auxiliary supply lines H31, H32, H33, H34, H35, H36, H37, and H38 and the third power supply portion 143 illustrated in FIG. 10 will make reference to FIG. 8 and the related descriptions, and further description thereof may be omitted.

First auxiliary supply lines H12, H13, H14, H15, H16, and H17 of FIG. 10 are located between adjacent pixel groups. In other words, the first auxiliary supply lines H12, H13, H14, H15, H16, and H17 are each located between adjacent pixel groups. For example, one of the first auxiliary supply lines, e.g., the first auxiliary supply line H12, is located between a first pixel group PG1 and a second pixel group PG2 which are adjacent to each other and another of the first auxiliary supply lines, e.g., the first auxiliary supply line H13, is located between the second pixel group PG2 and a third pixel group PG3 which are adjacent to each other.

In an exemplary embodiment, at least one of the first auxiliary supply lines H11, H12, H13, H14, H15, H16, H17, and H18 may be located between an upper edge S1 of a display panel 110 and a pixel group closest to the upper edge S1. For example, as illustrated in FIG. 10, one of the first auxiliary supply lines, e.g., the first auxiliary supply line H11, may be located between the upper edge S1 of the display panel 110 and the first pixel group PG1. In an exemplary embodiment, the first auxiliary supply line H11 located between the upper edge S1 of the display panel 110 and the first pixel group PG1 may be omitted.

In addition, at least one of the first auxiliary supply lines H11, H12, H13, H14, H15, H16, H17, and H18 may be located between a lower edge S2 of the display panel 110 and a pixel group closest to the lower edge S2. For example, as illustrated in FIG. 10, one of the first auxiliary supply lines, e.g., the first auxiliary supply line H18, may be located between the lower edge S2 of the display panel 110 and the seventh pixel group PG7. In an exemplary embodiment, the first auxiliary supply line H18 located between the lower edge S2 of the display panel 110 and the seventh pixel group PG7 may be omitted.

Second auxiliary supply lines H22, H23, H24, H25, H26, and H27 of FIG. 10 are located between adjacent pixel groups. In other words, the second auxiliary supply lines H22, H23, H24, H25, H26, and H27 are each located between adjacent pixel groups. For example, one of the second auxiliary supply lines, e.g., the second auxiliary supply line H22, is located between the first pixel group PG1 and the second pixel group PG2 which are adjacent to each other and another of the second auxiliary supply lines, e.g., the second auxiliary supply line H23, is located between the second pixel group PG2 and the third pixel group PG3 which are adjacent to each other.

In an exemplary embodiment, at least one of the second auxiliary supply lines H21, H22, H23, H24, H25, H26, H27, and H28 may be located between the upper edge S1 of the display panel 110 and a pixel group closest to the upper edge S1. For example, as illustrated in FIG. 10, one of the second auxiliary supply lines, e.g., the second auxiliary supply line H21, may be located between the upper edge S1 of the display panel 110 and the first pixel group PG1. In an exemplary embodiment, the second auxiliary supply line H22 located between the upper edge S1 of the display panel 110 and the first pixel group PG1 may be omitted.

In addition, at least one of the second auxiliary supply lines H21, H22, H23, H24, H25, H26, H27, and H28 may be located between a lower edge S2 of the display panel 110 and a pixel group closest to the lower edge S2. For example, as illustrated in FIG. 10, one of the second auxiliary supply lines, e.g., the second auxiliary supply line H28, may be located between the lower edge S2 of the display panel 110 and the seventh pixel group PG7. In an exemplary embodiment, the second auxiliary supply line H28 located between the lower edge S2 of the display panel 110 and the seventh pixel group PG7 may be omitted.

Third auxiliary supply lines H32, H33, H34, H35, H36, and H37 of FIG. 10 are located between adjacent pixel groups. In other words, the third auxiliary supply lines H32, H33, H34, H35, H36, and H37 are each located between adjacent pixel groups. For example, one of the third auxiliary supply lines, e.g., the third auxiliary supply line H32, is located between the first pixel group PG1 and the second pixel group PG2 which are adjacent to each other and another of the third auxiliary supply lines, e.g., the third auxiliary supply line H33, is located between the second pixel group PG2 and the third pixel group PG3 which are adjacent to each other.

In an exemplary embodiment, at least one of the third auxiliary supply lines H31, H32, H33, H34, H35, H36, H37, and H38 may be located between the upper edge S1 of the display panel 110 and a pixel group closest to the upper edge S1. For example, as illustrated in FIG. 10, one of the third auxiliary supply lines, e.g., the third auxiliary supply line H31, may be located between the upper edge S1 of the display panel 110 and the first pixel group PG1. In an exemplary embodiment, the third auxiliary supply line H31 located between the upper edge S1 of the display panel 110 and the first pixel group PG1 may be omitted.

In addition, at least one of the third auxiliary supply lines H31, H32, H33, H34, H35, H36, H37, and H38 may be located between the lower edge S2 of the display panel 110 and a pixel group closest to the lower edge S2. For example, as illustrated in FIG. 10, one of the third auxiliary supply lines, e.g., the third auxiliary supply line H38, may be located between the lower edge S2 of the display panel 110 and the seventh pixel group PG7. In an exemplary embodiment, the third auxiliary supply line H38 located between the lower edge S2 of the display panel 110 and the seventh pixel group PG7 may be omitted.

The third power supply portion 143 of FIG. 10 may directly apply a third high electric potential driving voltage ELVDD3 to all third auxiliary supply lines H31, H32, H33, H34, H35, H36, H37, and H38 included in the third power supply line VDL3. For example, one side end portions t31, t32, t33, t34, t35, t36, t37, and t38 of respective corresponding ones of the third auxiliary supply lines H31, H32, H33, H34, H35, H36, H37, and H38 are directly connected to an output terminal of the third power supply portion 143, and another side end portions t31', t32', t33', t34', t35', t36', t37', and t38' of respective corresponding ones of the third auxiliary supply lines H31, H32, H33, H34, H35, H36, H37, and H38 are directly connected to the output terminal of the third power supply portion 143. In such an exemplary embodiment, the number of output terminals of the third power supply portion 143 may be 1. Alternatively, the number of output terminals of the third power supply portion 143 may be substantially equal to the total of the number of respective one side end portions of the third main supply lines V31, V32, V33, V34, V35, and V36, the number of respective another side end portions of the third main supply lines V31, V32, V33, V34, V35, and V36, the number of said respective one side end portions of the third auxiliary supply lines H31, H32, H33, H34, H35, H36, H37, and H38, and the number of said respective another side end portions of the third auxiliary supply lines H31, H32, H33, H34, H35, H36, H37, and H38. In other words, when the number of output terminals of the third power supply portion 143 is a, the number of said respective one side end portions of the third main supply lines V31, V32, V33, V34, V35, and V36 is b, the number of said respective another side end portions of the third main supply lines V31, V32, V33, V34, V35, and V36 is c, the number of said respective one side end portions of the third auxiliary supply lines H31, H32, H33, H34, H35, H36, H37, and H38 is d, and the number of said respective another side end portions of the third auxiliary supply lines H31, H32, H33, H34, H35, H36, H37, and H38 is e, a may be equal to a sum of b, c, d and e, which is (b+c+d+e).

In an exemplary embodiment, the connection relationship between the first main supply lines V11, V12, V13, V14, V15, and V16 and the first power supply portion 141, the connection relationship between the second main supply lines V21, V22, V23, V24, V25, and V26 and the second power supply portion 142 and the connection relationship between the third main supply lines V31, V32, V33, V34, V35, and V36 and the third power supply portion 143 according to the present exemplary embodiment illustrated in FIG. 10 (i.e., an exemplary embodiment in which the first auxiliary supply lines are located between adjacent pixel groups) may be substantially the same as the connection relationship illustrated in FIGS. 3 to 9, and further description thereof may be omitted.

In addition, the connection relationship between the first auxiliary supply lines H11, H12, H13, H14, H15, H16, H17, and H18 and the first power supply portion 141, the connection relationship between the second auxiliary supply lines H21, H22, H23, H24, H25, H26, H27, and H28 and the second power supply portion 142, and the connection relationship between the third auxiliary supply lines H31, H32, H33, H34, H35, H36, H37, and H38 and the third power supply portion 143 may be substantially the same as the connection relationship illustrated in FIGS. 3 to 9, and further description thereof may be omitted.

Figure 11:
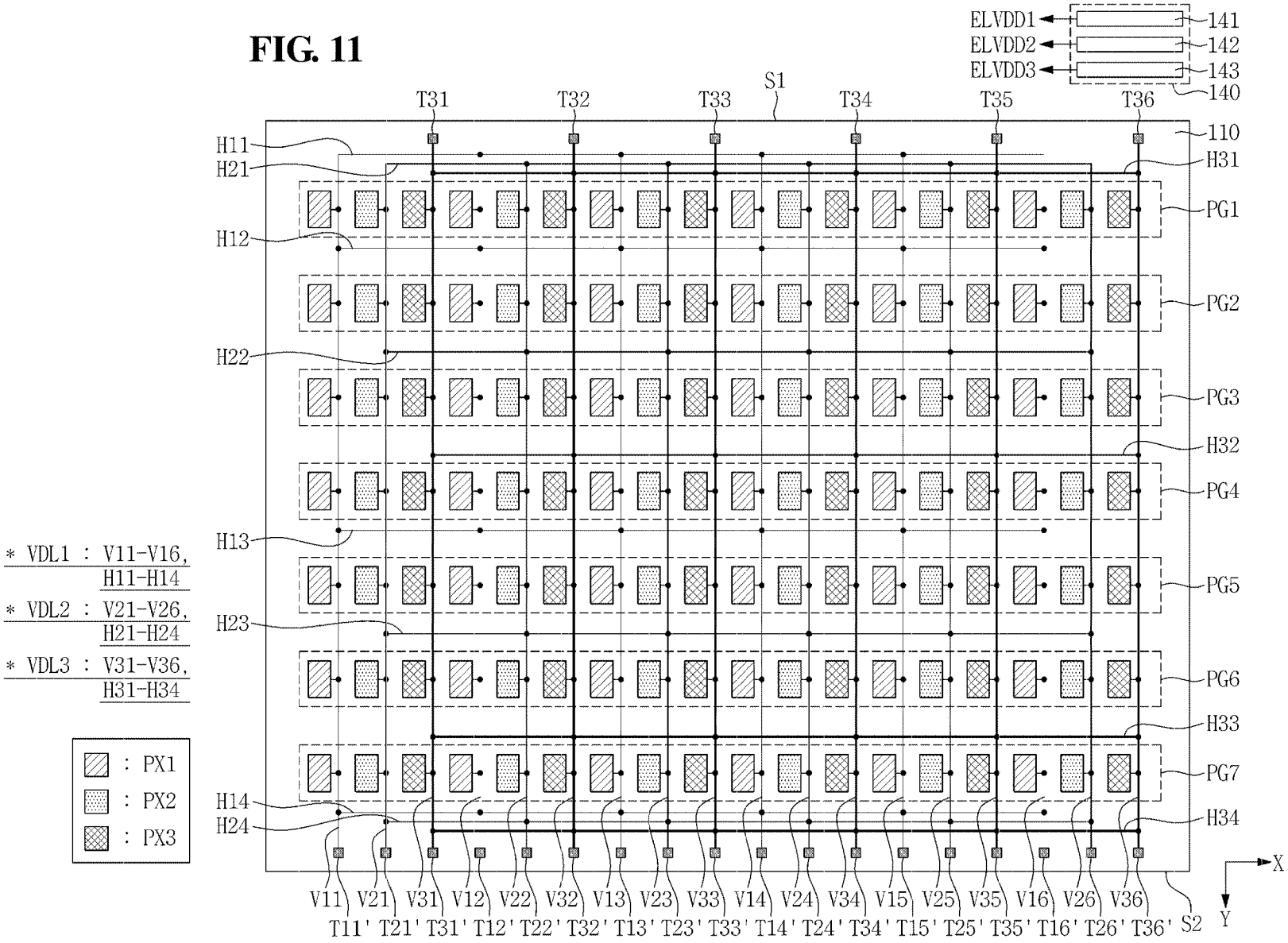
FIG. 11 is a view illustrating another alternative exemplary embodiment of a connection relationship between the pixels and the power supply portion of FIG. 1.

FIG. 11 is a view illustrating another alternative exemplary embodiment of a connection relationship between the pixels and the power supply portion of FIG. 1.

As described above, a power supply portion 140 outputs high electric potential driving voltages having different magnitudes. In other words, the power supply portion 140 outputs a first high electric potential driving voltage ELVDD1, a second high electric potential driving voltage ELVDD2, and a third high electric potential driving voltage ELVDD3. To this end, the power supply portion 140 may include a first power supply portion 141 outputting the first high electric potential driving voltage ELVDD1, a second power supply portion 142 outputting the second high electric potential driving voltage ELVDD2, and a third power supply portion 143 outputting the third high electric potential driving voltage ELVDD3.

The first high electric potential driving voltage ELVDD1 applied from the first power supply portion 141 is applied to first pixels PX1 through a first power supply line VDL1. To this end, first pixels PX1 of a display panel 110 are commonly connected to the first power supply line VDL1 and the first power supply line VDL1 is connected to the first power supply portion 141. The first power supply portion 141 outputs the first high electric potential driving voltage ELVDD1 through an output terminal of the first power supply portion 141, and the output terminal of the first power supply portion 141 is connected to the first power supply line VDL1.

The first power supply line VDL1 is located at the display panel 110. The first power supply line VDL1 may include at least one first main supply line and at least one first auxiliary supply line. For example, as illustrated in FIG. 11, the first power supply line VDL1 may include six first main supply lines V11, V12, V13, V14, V15, and V16 and four first auxiliary supply lines H11, H12, H13, and H14.

At least one first main supply line and at least one first auxiliary supply line are connected to each other. For example, the first main supply lines V11, V12, V13, V14, V15, and V16 and the first auxiliary supply lines H11, H12, H13, and H14 may be unitary.

Each of the first main supply lines V11, V12, V13, V14, V15, and V16 extends in the Y-axis direction. The first main supply lines V11, V12, V13, V14, V15, and V16 are arranged along the X-axis direction. Each of the first auxiliary supply lines H11, H12, H13, and H14 extends in the X-axis direction. The first auxiliary supply lines H11, H12, H13, and H14 are arranged along the Y-axis direction. At least one first main supply line and at least one first auxiliary supply line cross each other. Said at least one first main supply line and said at least one first auxiliary supply line may be connected to each other at their crossing points.

Assuming that the display panel 110 includes seven pixel groups PG1, PG2, PG3, PG4, PG5, PG6, and PG7 as illustrated in FIG. 11, for ease of descriptions, the first, second, third, fourth, fifth, sixth, and seven pixel groups PG1, PG2, PG3, PG4, PG5, PG6, and PG7 are arranged sequentially from an upper side of the display panel 110 along the Y-axis direction. In such an exemplary embodiment, the first auxiliary supply lines H12 and H13 are located between a (3q−2)-th pixel group and a (3q−1)-th pixel group which are adjacent to each other in the Y-axis direction, where q is a natural number. As a more specific example, as illustrated in FIG. 11, the first auxiliary supply lines H12 and H13 are located between the first pixel group PG1 and the second pixel group PG2 which are adjacent to each other and between the fourth pixel group PG4 and the fifth pixel group PG5 which are adjacent to each other, respectively.

In an exemplary embodiment, at least one of the first auxiliary supply lines H11, H12, H13, and H14 may be located between an upper edge S1 of the display panel 110 and a pixel group closest to the upper edge S1. For example, as illustrated in FIG. 11, one of the first auxiliary supply lines, e.g., the first auxiliary supply line H11, may be located between the upper edge S1 of the display panel 110 and the first pixel group PG1. In an exemplary embodiment, the first auxiliary supply line H11 located between the upper edge S1 of the display panel 110 and the first pixel group PG1 may be omitted.

In addition, at least one of the first auxiliary supply lines H11, H12, H13, and H14 may be located between a lower edge S2 of the display panel 110 and a pixel group closest to the lower edge S2. For example, as illustrated in FIG. 3, one of the first auxiliary supply lines, e.g., the first auxiliary supply line H14, may be located between the lower edge S2 of the display panel 110 and the seventh pixel group PG7. The lower edge S2 of the display panel 110 faces the upper edge S1 of the display panel 110 described above. In an exemplary embodiment, the first auxiliary supply line H14 located between the lower edge S2 of the display panel 110 and the seventh pixel group PG7 may be omitted.

The first power supply portion 141 directly applies the first high electric potential driving voltage ELVDD1 to at least one of the first main supply lines V11, V12, V13, V14, V15, and V16 and the first auxiliary supply lines H11, H12, H13, and H14 included in the first power supply line VDL1. For example, respective another side end portions T11', T12', T13', T14', T15', and T16' of the first main supply lines V11, V12, V13, V14, V15, and V16 may be directly connected to the output terminal of the first power supply portion 141.

The second high electric potential driving voltage ELVDD2 applied from the second power supply portion 142 is applied to second pixels PX2 through the second power supply line VDL2. To this end, the second pixels PX2 of the display panel 110 are commonly connected to the second power supply line VDL2 and the second power supply line VDL2 is connected to the second power supply portion 142. The second power supply portion 142 outputs the second high electric potential driving voltage ELVDD2 through an output terminal of the second power supply portion 142 and the output terminal of the second power supply portion 142 is connected to the second power supply line VDL2.

The second power supply line VDL2 is located at the display panel 110. The second power supply line VDL2 may include at least one second main supply line and at least one second auxiliary supply line. For example, as illustrated in FIG. 11, the second power supply line VDL2 may include six second main supply lines V21, V22, V23, V24, V25, and V26 and four second auxiliary supply lines H21, H22, H23, and H24.

At least one second main supply line and at least one second auxiliary supply line are connected to each other. For example, the second main supply lines V21, V22, V23, V24, V25, and V26 and the second auxiliary supply lines H21, H22, H23, and H24 may be unitary.

Each of the second main supply lines V21, V22, V23, V24, V25, and V26 extends in the Y-axis direction. The second main supply lines V21, V22, V23, V24, V25, and V26 are arranged along the X-axis direction. Each of the second auxiliary supply lines H21, H22, H23, and H24 extends in the X-axis direction. The second auxiliary supply lines H21, H22, H23, and H24 are arranged along the Y-axis direction. At least one second main supply line and at least one second auxiliary supply line cross each other. Said at least one second main supply line and said at least one second auxiliary supply line may be connected to each other at their crossing points.

The second auxiliary supply lines H22 and H23 are located between the (3q−1)-th pixel group and a 3q-th pixel group which are adjacent to each other in the Y-axis direction, where q is a natural number. As a more specific example, as illustrated in FIG. 11, the second auxiliary supply lines H22 and H23 are located between the second pixel group PG2 and the third pixel group PG3 which are adjacent to each other and between the fifth pixel group PG5 and the sixth pixel group PG6 which are adjacent to each other.

In an exemplary embodiment, at least one of the second auxiliary supply lines H21, H22, H23, and H24 may be located between the upper edge S1 of the display panel 110 and a pixel group closest to the upper edge S1. For example, as illustrated in FIG. 11, one of the second auxiliary supply lines, e.g., the second auxiliary supply line H21, may be located between the upper edge S1 of the display panel 110 and the first pixel group PG1. In an exemplary embodiment, the second auxiliary supply line H21 located between the upper edge S1 of the display panel 110 and the first pixel group PG1 may be omitted.

In addition, at least one of the second auxiliary supply lines H21, H22, H23 and H24 may be located between the lower edge S2 of the display panel 110 and a pixel group closest to the lower edge S2. For example, as illustrated in FIG. 11, one of the second auxiliary supply lines, e.g., the second auxiliary supply line H24, may be located between the lower edge S2 of the display panel 110 and the seventh pixel group PG7. In an exemplary embodiment, the second auxiliary supply line H24 located between the lower edge S2 of the display panel 110 and the seventh pixel group PG7 may be omitted.

The second power supply portion 142 directly applies the second high electric potential driving voltage ELVDD2 to at least one of the second main supply lines V21, V22, V23, V24, V25, and V26 and the second auxiliary supply lines H21, H22, H23, and H24 included in the second power supply line VDL2. For example, as illustrated in FIG. 11, respective another side end portions T21', T22', T23', T24', T25', and T26' of the second main supply lines V21, V22, V23, V24, V25, and V26 may be directly connected to the output terminal of the second power supply portion 142.

The third high electric potential driving voltage ELVDD3 applied from the third power supply portion 143 is applied to third pixels PX3 through the third power supply line VDL3. To this end, the third pixels PX3 of the display panel 110 are commonly connected to the third power supply line VDL3, and the third power supply line VDL3 is connected to the third power supply portion 143. The third power supply portion 143 outputs the third high electric potential driving voltage ELVDD3 through an output terminal of the third power supply portion 143 and the output terminal of the third power supply portion 143 is connected to the third power supply line VDL3.

The third power supply line VDL3 is located at the display panel 110. The third power supply line VDL3 may include at least one third main supply line and at least one third auxiliary supply line. For example, as illustrated in FIG. 11, the third power supply line VDL3 may include six third main supply lines V31, V32, V33, V34, V35, and V36 and four third auxiliary supply lines H31, H32, H33, and H34.

At least one third main supply line and at least one third auxiliary supply line are connected to each other. For example, the third main supply lines V31, V32, V33, V34, V35, and V36 and the third auxiliary supply lines H31, H32, H33, and H34 may be unitary.

Each of the third main supply lines V31, V32, V33, V34, V35, and V36 extends in the Y-axis direction. The third main supply lines V31, V32, V33, V34, V35, and V36 are arranged along the X-axis direction. Each of the third auxiliary supply lines H31, H32, H33, and H34 extends in the X-axis direction. The third auxiliary supply lines H31, H32, H33, and H34 are arranged along the Y-axis direction. At least one third main supply line and at least one third auxiliary supply line cross each other. Said at least one third main supply line and said at least one third auxiliary supply line may be connected to each other at their crossing points.

The third auxiliary supply lines H32 and H33 are located between the 3q-th pixel group and a (3q+1)-th pixel group which are adjacent to each other in the Y-axis direction, where q is a natural number. As a more specific example, as illustrated in FIG. 11, the third auxiliary supply lines H32 and H33 are located between the third pixel group PG3 and the fourth pixel group PG4 which are adjacent to each other and between the sixth pixel group PG6 and the seventh pixel group PG7 which are adjacent to each other.

In an exemplary embodiment, at least one of the third auxiliary supply lines H31, H32, H33, and H34 may be located between the upper edge S1 of the display panel 110 and a pixel group closest to the upper edge S1. For example, as illustrated in FIG. 11, one of the third auxiliary supply lines, e.g., the third auxiliary supply line H31, may be located between the upper edge S1 of the display panel 110 and the first pixel group PG1. In an exemplary embodiment, the third auxiliary supply line H31 located between the upper edge S1 of the display panel 110 and the first pixel group PG1 may be omitted.

In addition, at least one of the third auxiliary supply lines H31, H32, H33, and H34 may be located between the lower edge S2 of the display panel 110 and a pixel group closest to the lower edge S2. For example, as illustrated in FIG. 11, one of the third auxiliary supply lines, e.g., the third auxiliary supply line H34, may be located between the lower edge S2 of the display panel 110 and the seventh pixel group PG7. In an exemplary embodiment, the third auxiliary supply line H34 located between the lower edge S2 of the display panel 110 and the seventh pixel group PG7 may be omitted.

The third power supply portion 143 directly applies the third high electric potential driving voltage ELVDD3 to at least one of the third main supply lines V31, V32, V33, V34, V35, and V36 and the third auxiliary supply lines H31, H32, H33, and H34 included in the third power supply line VDL3. For example, as illustrated in FIG. 11, respective one side end portions T31, T32, T33, T34, T35, and T36 of the third main supply lines V31, V32, V33, V34, V35, and V36 may be directly connected to the output terminal of the third power supply portion 143, and respective another side end portions T31', T32', T33', T34', T35', and T36' of the third main supply lines V31, V32, V33, V34, V35, and V36 may be directly connected to the output terminal of the third power supply portion 143.

In an exemplary embodiment, the connection relationship between the first main supply lines V11, V12, V13, V14, V15, and V16 and the first power supply portion 141, the connection relationship between the second main supply lines V21, V22, V23, V24, V25, and V26 and the second power supply portion 142, and the connection relationship between the third main supply lines V31, V32, V33, V34, V35, and V36 and the third power supply portion 143 according to the present exemplary embodiment illustrated in FIG. 11 may be substantially the same as the connection relationship illustrated in FIGS. 3 to 9, and further description thereof may be omitted.

In addition, the connection relationship between the first auxiliary supply lines H11, H12, H13, and H14 and the first power supply portion 141, the connection relationship between the second auxiliary supply lines H21, H22, H23, and H24 and the second power supply portion 142, and the connection relationship between the third auxiliary supply lines H31, H32, H33, and H34 and the third power supply portion 143 may be substantially the same as the connection relationship illustrated in FIGS. 3 to 9, and further description thereof may be omitted.

As described above, so as to achieve white balance, a high electric potential driving voltage applied to a blue pixel may be higher than another high electric potential driving voltage. In other words, when the third pixel PX3 is a blue pixel, the third high electric potential driving voltage ELVDD3 applied to the third pixel PX3 is higher than another high electric potential driving voltage. Accordingly, a driving current flowing through the third power supply line VDL3 is larger than a driving current flowing through another power supply line. As illustrated in FIG. 11, the third high electric potential driving voltage ELVDD3 is applied to said one side end portions T31, T32, T33, T34, T35, and T36 and said another side end portions T31', T32', T33', T34', T35', and T36' of respective corresponding ones of the third main supply lines V31, V32, V33, V34, V35, and V36 so that the driving current may flow more easily through the third power supply line VDL3.

At least two of the first power supply line VDL1, the second power supply line VDL2, and the third power supply line VDL3 illustrated in FIGS. 3 to 11 may have different widths (e.g., line widths). For example, as illustrated in FIG. 3, the third power supply line VDL3 may have a largest width. The respective widths of the first power supply line VDL1, the second power supply line VDL2, and the third power supply line VDL3 mean widths of corresponding power supply lines measured in the X-axis direction or the Y-axis direction.

As described above, so as to achieve white balance, a high electric potential driving voltage applied to a blue pixel may be higher than another high electric potential driving voltage. In other words, when the third pixel PX3 is a blue pixel, the third high electric potential driving voltage ELVDD3 applied to the third pixel PX3 is higher than another high electric potential driving voltage. Accordingly, a driving current flowing through the third power supply line VDL3 is larger than a driving current flowing through another power supply line. As illustrated in FIG. 3, the third power supply line VDL3 may have a largest width so that the driving current (e.g., the largest driving current) may flow more easily through the third power supply line VDL3.

In an exemplary embodiment, the width of the second power supply line VDL2 may be larger than the width of the first power supply line VDL1. Alternatively, the width of the second power supply line VDL2 may be substantially equal to the width of the first power supply line VDL1.

According to the structure of FIG. 11, since only one auxiliary supply line is located at an area between adjacent pixel groups, the light emitting display device according to an exemplary embodiment may have high space utilization. That is, each of the areas may be utilized as a space for another additional element, for example, a sensing element.

As set forth hereinabove, the light emitting display device according to one or more exemplary embodiments may provide the following effects.

First, pixels having different colors receive high electric potential driving voltages having different magnitudes. Accordingly, the light emitting display device according to one or more exemplary embodiments may maintain excellent white balance.

Second, according to the structure of FIG. 3 according to an exemplary embodiment, auxiliary supply lines are absent in some of areas between adjacent pixel groups. Accordingly, the light emitting display device according to one or more exemplary embodiments may have high space utilization.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

While the present invention has been illustrated and described with reference to the exemplary embodiments thereof, it will be apparent to those of ordinary skill in the art that various changes in form and detail may be formed thereto without departing from the spirit and scope of the present invention. Thus, the present embodiments of the invention should be considered in all respects as illustrative and not restrictive, the scope of the invention to be indicated by the appended claims and their equivalents.

What is claimed is:

1. A light emitting display device comprising:

a display panel comprising a plurality of pixel groups arranged along a first direction;

first, second, and third pixels comprised in each of the pixel groups, arranged in a second direction which crosses the first direction, and respectively configured to emit light having different colors;

a data line connected to the first, second, and third pixels, the data line extending in the first direction;

a light emitting element comprised in each of the first, second, and third pixels;

a first power supply line connected to the light emitting element of each of the first pixels of each of the pixel groups;

a second power supply line connected to the light emitting element of each of the second pixels of each of the pixel groups;

a third power supply line connected to the light emitting element of each of the third pixels of each of the pixel groups;

at least one first main supply line and at least one first auxiliary supply line comprised in the first power supply line and connected to each other;

at least one second main supply line and at least one second auxiliary supply line comprised in the second power supply line and connected to each other; and at least one third main supply line and at least one third auxiliary supply line comprised in the third power supply line and connected to each other, wherein said at least one first auxiliary supply line, said at least one second auxiliary supply line, and said at least one third auxiliary supply line are located between a p-th pixel group and a (p+1)-th pixel group, and p is one of an odd number and an even number, wherein the first to third main supply lines extend in the first direction, wherein the first to third auxiliary supply lines extend in the second direction, and wherein the number of auxiliary supply lines between two pixels adjacent in the first direction is greater than the number of main supply lines between two pixels adjacent in the second direction.

2. The light emitting display device as claimed in claim 1, wherein said at least one first auxiliary supply line, said at least one second auxiliary supply line, and said at least one third auxiliary supply line are located between a (2q−1)-th pixel group and a 2q-th pixel group which are adjacent to each other, wherein said at least one first auxiliary supply line, said at least one second auxiliary supply line, and said at least one third auxiliary supply line are not located between the 2q-th pixel group and a (2q+1)-th pixel group which are adjacent to each other, and wherein q is a natural number.

3. The light emitting display device as claimed in claim 1, wherein said at least one first auxiliary supply line, said at least one second auxiliary supply line, and said at least one third auxiliary supply line are located between a 2q-th pixel group and a (2q+1)-th pixel group which are adjacent to each other, wherein said at least one first auxiliary supply line, said at least one second auxiliary supply line, and said at least one third auxiliary supply line are not located between a (2q−1)-th pixel group and the 2q-th pixel group which are adjacent to each other, and wherein q is a natural number.

4. The light emitting display device as claimed in claim 1, wherein said at least one first main supply line, said at least one second main supply line, and said at least one third main supply line are arranged along the second direction.

5. The light emitting display device as claimed in claim 1, wherein said at least one first auxiliary supply line, said at least one second auxiliary supply line, and said at least one third auxiliary supply line are arranged along the first direction.

6. The light emitting display device as claimed in claim 1, further comprising:

a first power supply portion configured to apply a first driving power to at least one of said at least one first main supply line and said at least one first auxiliary supply line;

a second power supply portion configured to apply a second driving power to at least one of said at least one second main supply line and said at least one second auxiliary supply line; and a third power supply portion configured to apply a third driving power to at least one of said at least one third main supply line and said at least one third auxiliary supply line.

7. The light emitting display device as claimed in claim 6, wherein the first power supply portion is connected to one side end portion of said at least one first main supply line, wherein the second power supply portion is connected to one side end portion of said at least one second main supply line, and wherein the third power supply portion is connected to one side end portion of said at least one third main supply line.

8. The light emitting display device as claimed in claim 7, wherein the first power supply portion is further connected to another side end portion of said at least one first main supply line, wherein the second power supply portion is further connected to another side end portion of said at least one second main supply line, and wherein the third power supply portion is further connected to another side end portion of said at least one third main supply line.

9. The light emitting display device as claimed in claim 7, wherein a largest current flows through the third power supply line of the first power supply line, the second power supply line, and the third power supply line, and wherein the third power supply portion is further connected to another side end portion of said at least one third main supply line.

10. The light emitting display device as claimed in claim 9, wherein the first power supply portion is further connected to one side end portion and another side end portion of said at least one first auxiliary supply line.

11. The light emitting display device as claimed in claim 7, wherein the first power supply portion is further connected to another side of said at least one first main supply line, wherein the second power supply portion is further connected to another side of said at least one second main supply line, and wherein the third power supply portion is further connected to another side of said at least one third main supply line.

12. The light emitting display device as claimed in claim 11, wherein the first power supply portion is further connected to one side end portion and another side end portion of the first auxiliary supply line, wherein the second power supply portion is further connected to one side end portion and another side end portion of the second auxiliary supply line, and wherein the third power supply portion is further connected to one side end portion and another side end portion of the third auxiliary supply line.

13. The light emitting display device as claimed in claim 7, wherein a largest current flows through the third power supply line of the first power supply line, the second power supply line, and the third power supply line, and wherein the third power supply portion is further connected to another side end portion of said at least one third main supply line, one side end portion of said at least one third auxiliary supply line, and another side end portion of said at least one third auxiliary supply line.

14. The light emitting display device as claimed in claim 13, wherein the second power supply portion is further connected to another side end portion of said at least one second auxiliary supply line, and wherein the third power supply portion is further connected to another side end portion of said at least one third main supply line.

15. The light emitting display device as claimed in claim 1, wherein at least two of the first, second, and third power supply lines have different widths.

16. The light emitting display device as claimed in claim 15, wherein a largest current flows through the third power supply line of the first power supply line, the second power supply line, and the third power supply line, and wherein the third power supply line of the first power supply line, the second power supply line, and the third power supply line has a largest width.

17. The light emitting display device as claimed in claim 1, wherein one of the main supply lines is arranged between two adjacent ones of the pixels, and wherein two adjacent ones of the main supply lines are connected to different ones of the auxiliary supply lines.

* * * * *